US006536366B1

(12) United States Patent
Zilliacus

(10) Patent No.: US 6,536,366 B1
(45) Date of Patent: Mar. 25, 2003

(54) UNDERWATER EXPLOSION TEST VEHICLE

(75) Inventor: Stephen Zilliacus, Silver Spring, MD (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 10/061,190

(22) Filed: Feb. 4, 2002

(51) Int. Cl.[7] ..... B63G 8/00
(52) U.S. Cl. ..... 114/312; 114/382
(58) Field of Search ..... 114/65 R, 355, 114/312, 313, 382

(56) References Cited

U.S. PATENT DOCUMENTS 4,525,013 A * 6/1985 Phillips ..... 439/6
5,073,136 A * 12/1991 DeWitt et al. ..... 441/7
5,251,471 A * 10/1993 Minten ..... 73/40

* cited by examiner

*Primary Examiner*—Stephen Avila
(74) *Attorney, Agent, or Firm*—Howard Kaiser

(57) ABSTRACT

A substitutive model is no more than one-third the size and weight of the archetypical model as originally built or conceived, hence is more wieldy and affordable, yet yields comparable UNDEX test data. The substitutive model comprises two congruous accordion-like "concertina" components and an intermediate smooth cylindrical sectional hull component. The concertina components each have circumferential pleats, generally describe a cylindrical shape, are coaxially joined with the intermediate hull component, and are thus so configured and arranged as to imbue the substitutive model with underwater explosion response (e.g., flexural) properties which approximate those of the archetypical model. Frequent inventive practice dictates that, as compared with the archetypical model, a substitutive model: of equal diameter, will have one-third the length and one-third the weight; of lesser diameter, will have a length which is one-third times the diametric fraction, and a mass which is one-third times the diametric fraction cubed.

20 Claims, 22 Drawing Sheets

| Piece No. | Name of Piece | No. Req. | Material | Remarks |
|---|---|---|---|---|
| 1 | Main Shell | 1 | HY-80 | 0.375" Thk Plt |
| 2 | End Ring | 2 | HY-80 | 0.625 " Thk Plt |
| 3 | Typical Frame Flange | 22 | HY-80 | 0.375" Thk Plt |
| 4 | Typical Frame Web | 22 | HY-80 | 0.250" Thk Plt |
| 5 | Deep Frame Flange | 1 | HY-80 | 0.75" Thk Plt |
| 6 | Deep Frame Web | 1 | HY-80 | 0.375" Thk Plt |
| 7 | Bolt Ring | 2 | Grade 80 | 3" Thk Plt |
| 8 | Shell Insert | 1 | HY-80 | 0.625" Thk Plt |
| 9 | Concertina Shell | 2 | Mild Steel | 1/4" Thk Plt |
| 10 | Inner Bulkhead | 2 | Mild Steel | 2-1/2" Thk Plt* |
| 11 | Outer Bulkhead | 2 | Mild Steel | 2" Thk Plt** |
| 12 | Inner Manhole Cover | 2 | Aluminum*** | 1" Thk Plt*** |
| 13 | Outer Manhole Cover | 2 | Aluminum*** | 1" Thk Plt*** |
| 14 | Globe Valves | 8 | Steel | 3" ID |
| 15 | Pipe Caps | 8 | Steel | 3" ID |
| 16 | 1" Dia Bolts | 36 | Grade 8 | 2" Long std thread |
| 17 | 3/4" Dia Bolts | 36 | Grade 8 | 2-1/4" Long std thread |

* Thickness increase or augmentation required for operation at depth

** Should weight become a problem, then reduction to 1.5" thickness would be permissible

*** Replacement and redesign for operation at depth

FIG. 7

Roots $r_n l$ Frequency Equations for Single-Span Beams*

| End Conditions | $r_n l$ | | | | | | General Expressions for $r_n l$ |
|---|---|---|---|---|---|---|---|
| | $n$=1 | $n$=2 | $n$=3 | $n$=4 | $n$=5 | $n$=6 | |
| 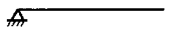 | 0 | 3.927 | 7.069 | 10.210 | 13.352 | 16.493 | $\approx (n - 3/4)\pi,\ n \geq 2$ |
| 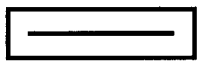 | 0 | 4.730 | 7.853 | 10.996 | 14.137 | 17.279 | $\approx (n - 1/2)\pi,\ n \geq 2$ |
| 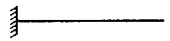 | 1.875 | 4.694 | 7.855 | 10.966 | 14.317 | 17.279 | $\approx (n - 1/2)\pi,\ n \geq 3$ |
| 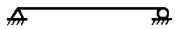 | 3.142 | 6.283 | 9.425 | 12.566 | 15.708 | 18.850 | $\approx n\pi$ |
| 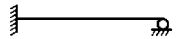 | 3.927 | 7.069 | 10.210 | 13.352 | 16.493 | 19.635 | $\approx (n + 1/4)\pi$ |
| 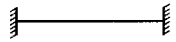 | 4.730 | 7.853 | 10.996 | 14.137 | 17.279 | 20.420 | $\approx (n + 1/2)\pi$ |

*The natural frequencies are given by $$p_n = \frac{(r_n l)^2}{l^2}\, b = \frac{(r_n l)^2}{l^2}\sqrt{\frac{EIg}{A\gamma}} = (r_n l)^2 p_w \quad rad/sec$$

$$p_w = \frac{[EI/\mathrm{m}]^{1/2}}{l^2} \qquad \mathrm{m} = \text{mass/unit length}$$

FIG. 20

| Model | Condition or Property | | Weight (lb) |
|---|---|---|---|
| POISSON BLANC (PB) | Dry-Dry* | Empty | 40 420 |
| | Dry-Dry | w Internals | 48 020 |
| | Dry-Wet | Empty | 55 020 |
| | Displacement | (Submerged) | 68 180 |
| | Wet-Wet | Empty | ~99 200 |
| | Wet-Wet | w Internals | 106 800 |
| WHITEFISH (WF) | Dry-Dry | Empty | ~142 510 |
| (Model Scale Prototype) | Displacement | Empty | ~176 280 |

- Dry-Dry ↔ no interior water — no fluid added mass
- Dry-Wet ↔ no interior water — fluid added mass
- Wet-Wet ↔ interior water — fluid added mass

WF wght / B wght = 142 510 # / 40 200 # = 3.53

| Code | Solution | Model | Invstgtr | Lwst Bm Freq |
|---|---|---|---|---|
| SUBWHIP* | Transnt UNDEX & EIGEN | Dry-Wet Empty WF | Harris IHD | 12.2 Hz |
| LSDYNA3D** | Transnt CENTRAL DIRAC | Wet-Wet Empty PB | Zilliacus CD | 13. |
| USA-LSDYNA3D | Transnt UNDEX & FFT*** | Wet-Wet Internals PB | Milligan APL | 13. |
| USA-ABAQUS | Transnt UNDEX & FFT | Wet-Wet Empty PB | Chrysostom CD | 17. |
| 7SA-VECDYNA | Transnt UNDEX | Wet-Wet Empty PB | Schweich CD | 18. |

* Fluid structure interaction beam code. IHD: NSWC or Naval Surface Weapon Center Indian Head Division

** "Initial value" problem-beam element model. CD: NSWC Carderock Division

*** USA implies fluid-structure interaction approximation codes (struct modeling w/shell elements) FFT implies Fast Fourier Transform. APL: Johns Hopkins U. Applied Physics Laboratory

| Source | State | Bm Mode No.: | 2 | 4 | 6 | (also no. of Nodes) |
|---|---|---|---|---|---|---|
| Jacobsen & Ayre (theoretical for prismatic section) | Free-Free BM | Normalized Freq et seq: | 1. | 2.32 | 3.65 | |
| SUBWHIP* | Dry-Wet Empty | Frq (Hz) et seq: | 12. | 50. | 85.* | Bendt/Harris WF |
| | | Normalized: | 1. | 4.17 | 7.08 | |
| LSDYNA3D** | Wet-Wet Internals | 4 | 13. | | 74. | Milligan PB |
| | | Normalized: | 1. | | 5.69 | |
| USA-ABAQUS | Wet-Wet Empty | 3 | 17. | 50.** | 100. | Chrysostom PB |
| | | Normalized: | 1. | 2.94 | 5.88 | |
| 7SA-VECDYNA | Wet-Wet Empty | | 18. | 49. | 91. | Schweich PB |
| | | Normalized: | 1. | 2.72 | 5.28 | |

* Extrapolated from 4 lowest frequencies

** First lobar (circumferential) mode frequency (47 Hz) is very close to this beam mode frequency of 50 Hz

FIG. 21

UNDERWATER EXPLOSION TEST VEHICLE

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION

The present invention relates to methods and apparatuses for testing the response of a structure to an explosive event, more particularly for testing the response of a submerged hull structure such as a submarine to an underwater explosive event.

During a typical underwater explosion (UNDEX) test, the target is a hull model which is initially struck by a shock wave. Typically, the shock wave results from conversion of about half the chemical potential (explosive charge) energy into kinetic energy in the water surrounding the charge. The explosion products form a bubble which expands to maximum size in a span of ~100 times the time constant of the steep fronted, exponentially decaying, free field incident shock wave. The shock wave response of the target to this later, more slowly applied pressure load is characterized by lower frequency and longer wavelength motion. This is in comparison with the shock wave response of the target to the earlier, more rapidly applied pressure load which is characterized by higher frequency and shorter wavelength motion.

Submersible hulls are tested, particularly with respect to internal/external equipment survival, in underwater explosion environments. This testing includes UNDEX model testing, often at reduced scale, but in some cases at full scale. Various test vehicles ("targets") have been designed, fabricated and tested over the past half century. Most of these have been short (length/diameter ratio of ~1), therefore responding primarily in early shock deformational modes involving higher frequencies and shorter wavelengths. Longer models (length/diameter ratios of ~9) have been employed when special circumstances have demanded additional kinds of response, such as the bending ("whipping") motion associated with later shock deformational modes involving lower frequencies and longer wavelengths. Such vehicles, even at reduced scale, but large enough to allow inclusion of essential details, can become heavy (e.g., about 64 long tons dry with about 80 long tons displacement), and expensive (e.g., about two million dollars).

For a particular project, the inventor and his colleagues considered a mechanically excited (e.g., via impact) "dry land" approach. However, such approach was dismissed as untenable in view of the huge mass required to simulate the dynamic participation of the adjacent ballasting structure and fluid in addition to that of the hull test section itself and the equipment within. Other factors also pointed to the preferability of a "submerged" approach to testing. According to a "dry land" approach, the simulated fluid "added" mass would have to be absolutely devoid of shear stiffness, a difficult proposition. Furthermore, it would be difficult to simulate UNDEX loading "in the dry."

SUMMARY OF THE INVENTION

In view of the foregoing, it is an object of the present invention to provide method and apparatus for simulating submarine hull target response to UNDEX (underwater explosion) excitation.

Another object of the present invention is to provide method and apparatus for measuring both high and low frequency response components to UNDEX load in submersible hulls and equipment.

A further object of the present invention is to provide method and apparatus, characterized by reusability, for deducing velocities and stresses in submarine hulls and in internal equipment for purposes of assessing the survivability of novel or extant hull, equipment or equipment-support designs.

Yet another object of the present invention is to provide method and apparatus, characterized by cost-effectiveness, for determining hull and equipment UNDEX response and survivability.

In accordance with typical embodiments of the present invention, a vehicle comprises three hollow, axially aligned, axially symmetrical sections, viz., a hull section and two bellows sections. The hull section has two hull section ends. Each bellows section generally describes a peripherally (e.g., approximately perimetrically or approximately circumferentially) pleated shape and is attached at a hull section end. The vehicle is adaptable to use in association with explosion means for testing response to underwater explosion. Each bellows section attributes the vehicle with axial flexibility responsive to the underwater explosion.

The terms "bellows" and "concertina," as used herein, each synonymously refer to any apparatus generally characterized by a geometric axis and a plurality of generally parallel and generally peripheral (e.g., perimetric or circumferential) folds, bends or pleats which attribute the apparatus with a degree of flexibility in the generally axial direction. A typical bellows or concertina apparatus in accordance with the present invention is analogous to a bellows or concertina apparatus which is included in, part of or associated with a type of musical instrument commonly known as an "accordion."

In accordance with the present invention, a vessel is provided which may be used as a test model for evaluating the response of a full-scale version thereof to an underwater explosive event. In particular, a submarine test vehicle is provided by the present invention to determine both early (high frequency) and late (low frequency) UNDEX hull and equipment response. Of particular note is the present invention's capability of determining late (low frequency) UNDEX hull and equipment response. Associated with late (low frequency) UNDEX hull response is a hull "whipping" motion. In the past, when "whipping" motion required study, long models (e.g., length/diameter ratios of ~9) were employed. As previously pointed out herein, such vehicles, albeit at reduced scale but nevertheless large enough to enclose essential details, tend to be massive and costly. The present invention's test vehicle can be excited, without damage, up to design severities, in "accordion" modes previously inattainable in any vehicle having a length/diameter ratio as low as 3. Hence, the present invention's test submersible is typically characterized by a relatively low length/diameter ratio, and yet affords test information comparable in value to that afforded by a conventional test submersible characterized by a much higher length/diameter ratio (e.g., ~9) as well as realistic flexural/longitudinal modes. Accordingly, the present invention is a "short" UNDEX model whose submerged vibration characteristics simulate those of a "long" prototype.

The inventive submarine model vehicle subjected to inventive testing has been dubbed by the inventor the "Poisson Blanc" (PB) in contradistinction to a like diameter generic submarine pressure hull model prototype which is three times longer, named the "Whitefish." The inventive testing demonstrated that the inventive Poisson Blanc's response to underwater explosion loading simulates or mimics that of the Whitefish. The inventive PB thus represents a dynamic surrogate of the longer prototype. The inventive PB's middle or central part is a generic ring-stiffened (e.g., cylindrical) pressure hull test section, of arbitrary design, which houses equipment. At each end of the middle test section is a perforated (bolt ring) flange. Bolted to each flange is a "concertina" or "bellows" apparatus which is just over a quarter of the test section in length. Each bellows apparatus has two manhole-equipped (hatch-equipped) end plates (bulkheads). Further, each bellows apparatus has one or more valves (located at the outboard bulkheads, only) for intake and scavenging (expulsion) of liquid (e.g., water) or gas (e.g., air). Accordingly, the bellows (concertina) apparati pair provides for: (i) submergence (diving) ballast for the inventive model vehicle; and, (ii) the combination of low stiffness and large inertia of the inventive model vehicle, thereby together enabling low frequency bending (i.e., axial and bending, or according to this invention "beam/accordion" deformation) to take place. The UNDEX loading external to the inventive PB vehicle is measured by pressure gauges, while response measurements of the vehicle and the equipment under investigation are obtained by means of strain gauges, relative displacement gauges, force gauges, velocity meters and/or accelerometers.

In accordance with the present invention, each "concertina" behaves in a manner analogous to that which the name implies. When a musician plays a musical instrument known as a "concertina," the musician's hands translate 180 degrees out-of-phase, alternately compressing and expanding the concertina's bellows. Thus, each concertina bellows manifests both axial compressive action and axial tensile action. While this is occurring, the musician's hands simultaneously rotate. The combined effect of all of this activity is both axial (compressive and tensile) motion and bending (lateral) motion of the bellows. Bending motion of the concertina bellows would occur simply by virtue of the interaction between compression and expansion of adjacent "pleats"—that is, even in the absence of rotation of the musician's hands. Pure bending, in isolation, will result from the simultaneous conditions of (i) the compression of a first set of pleats and (ii) the expansion of a second set of pleats which, in function or effect, are "diametrically opposite" the first set. Bellows movement, therefore, basically consists of a combination of bending and axial components.

The principles elaborated upon in the preceding paragraph are applicable to the present invention's Poisson Blanc. In inventive practice, a distinction is drawn between: (a) the excitation of the middle test section by one or both concertina sections; and, (b) the response of the middle test section to such excitation by one or both concertina sections. While the middle test section's excitation is both axial and flexural in nature, the middle test section's response is primarily flexural. This situation essentially results from the very high axial stiffness of the middle test section. In fact, the middle test section does vibrate axially, but at much higher frequencies. Since the axial vibrations of the middle test section will generally be at such high frequencies, they will generally not be of great significance in the context of inventive practice of UNDEX experimentation. Generally, although the inventive practitioner will obtain both axial and flexural responses, the flexural frequencies will be important, whereas the axial frequencies (which will usually be of about an order of magnitude higher than flexural frequencies) will not be important. Of main concern in typical embodiments of the present invention is the ability to obtain correct flexural response from the coupled axial/flexural concertina motion.

As an aside, the axial displacement of a row of individual leaves is a fair illustration of inextensional bending. The term "inextensional bending" refers to a class of plate and shell response problems in which the potential energy is dominated by flexural strains as opposed to extensional strains. Inextensional bending is of little import in the present invention, however, as behavior "in the large" is of greatest interest in inventive practice.

The present invention thus provides a unique UNDEX test vehicle. The present invention's vehicle is capable of being excited, without damage, up to severities at design values, in "accordion" modes heretofore unattainable in any UNDEX test vehicle having a length/diameter ratio as low as three. The low ratio value of approximate magnitude three for the present invention's submersible device contrasts markedly with the usual ratio values of approximate magnitude nine for submersible devices possessing significant flexural and longitudinal vibration modes. Thus, the present invention is a "short" UNDEX model having submerged bending and axial vibration characteristics which duplicate those of a "long" prototype.

Other objects, advantages and features of this invention will become apparent from the following detailed description of the invention when considered in conjunction with the accompanying drawings.

BRIEF DESCRIPTION OF THE DRAWINGS

In order that the present invention may be clearly understood, it will now be described, by way of example, with reference to the accompanying drawings, wherein like numbers indicate the same or similar components, and wherein:

FIG. 7 is a descriptive tabular representation of parts, components and materials used for assembling the inventive vehicle shown in FIG. 2.

2, particularly illustrating locations of pressure gauges (FIG. 8*a*), strain gauges (FIG. 8*b*) and velocity meters (FIG. 8*c*) in association with the medially situated hull section.

Figure 2:
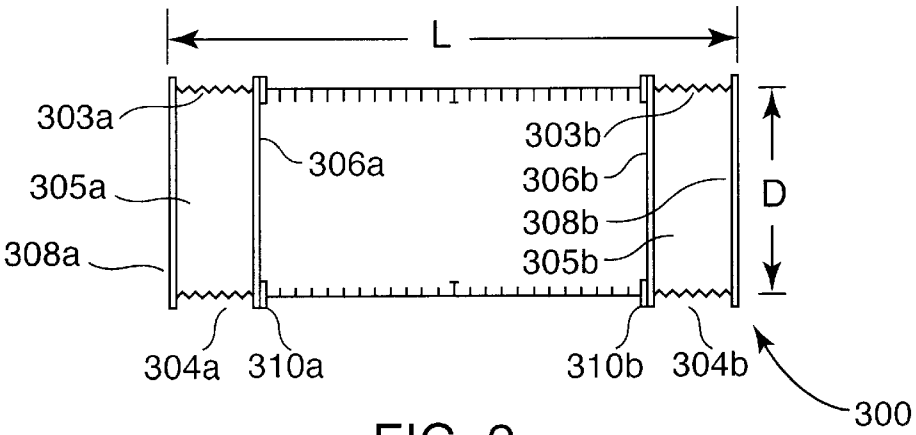
FIG. 2 is a diagrammatic cross-sectional longitudinal elevation view of an embodiment of a "short" dynamic surrogate vehicle according to inventive practice.
Figure 3:
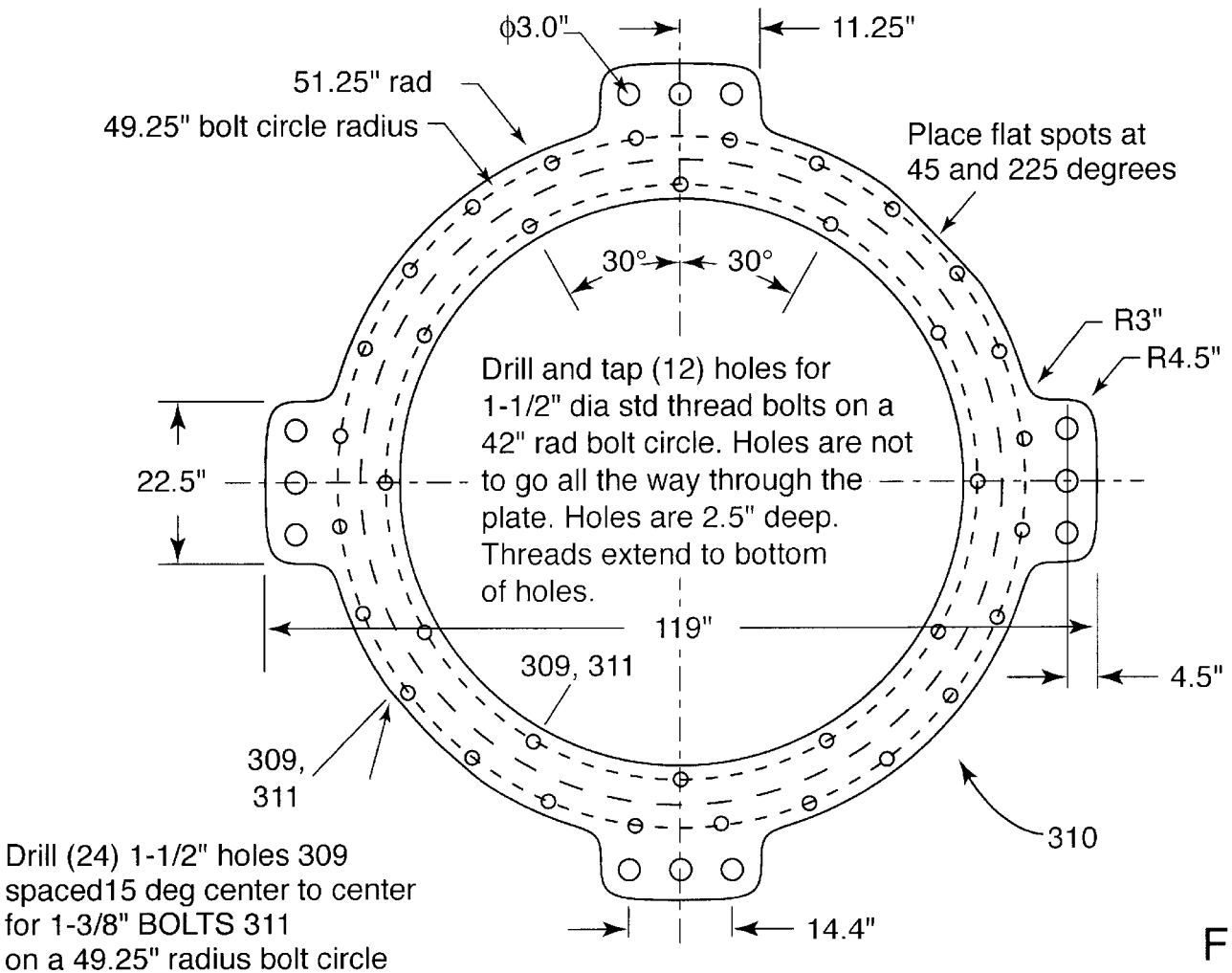
FIG. 3 is a diagrammatic obverse elevation view of one of two identical test section bolt flanges or rings, each fastened to an inboard bulkhead such as shown in FIG. 4, thereby joining a concertina section at an end of the medially situated hull section in the inventive vehicle shown in FIG. 2.
Figure 9:
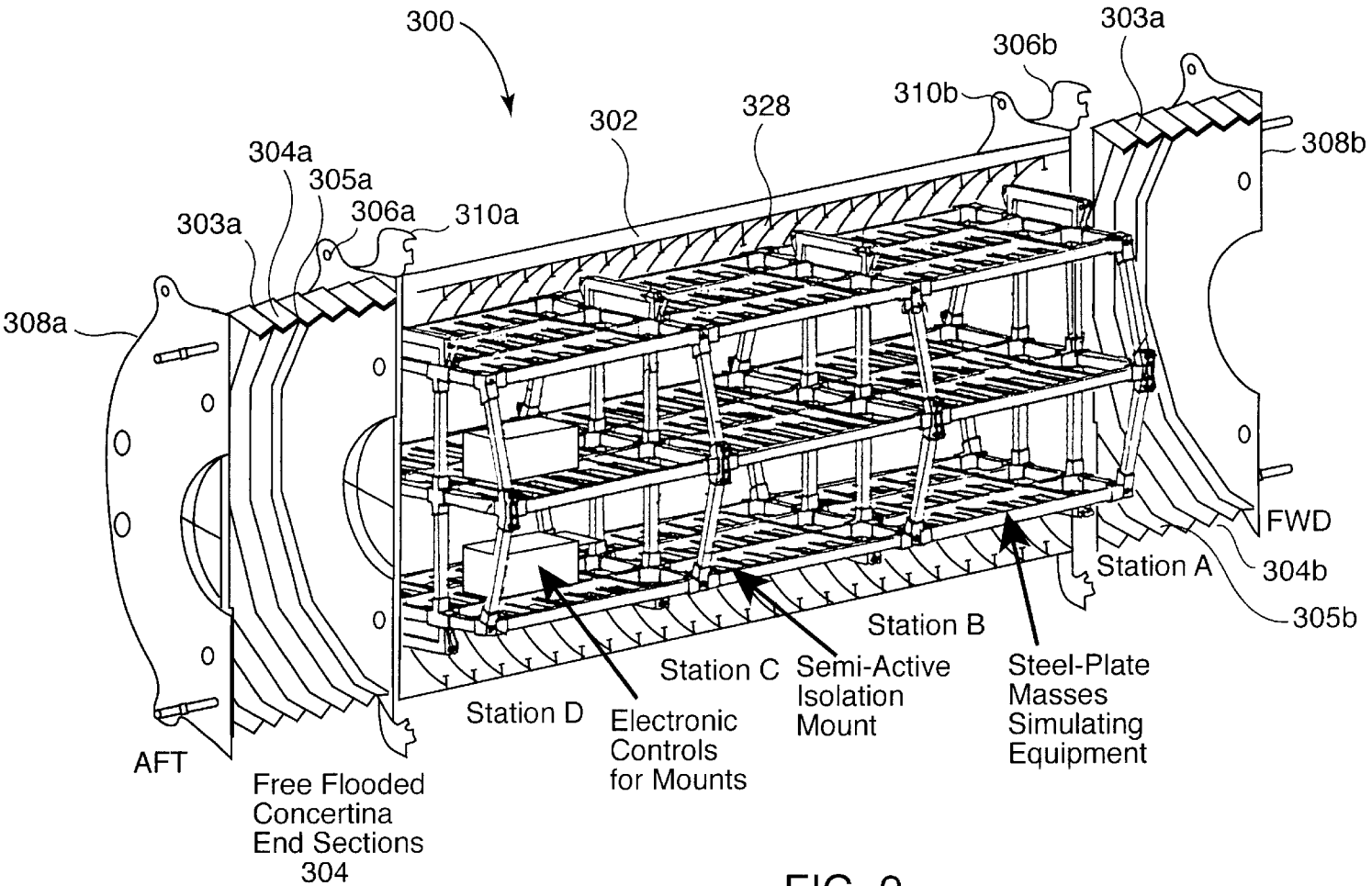

FIG. 9 is a diagrammatic cross-sectional longitudinal perspective view of the inventive vehicle shown in FIG. 2, particularly illustrating an equipment support space frame (a space frame for supporting relatively light equipment) such as may be used in association with the medially situated hull section shown in FIG. 2. Also shown are the locations of the instruments supported by the space frame, such as accelerometers, frame-hull relative displacement gauges (at mounts), and frame-hull force gauges (at mounts).

Figure 10:
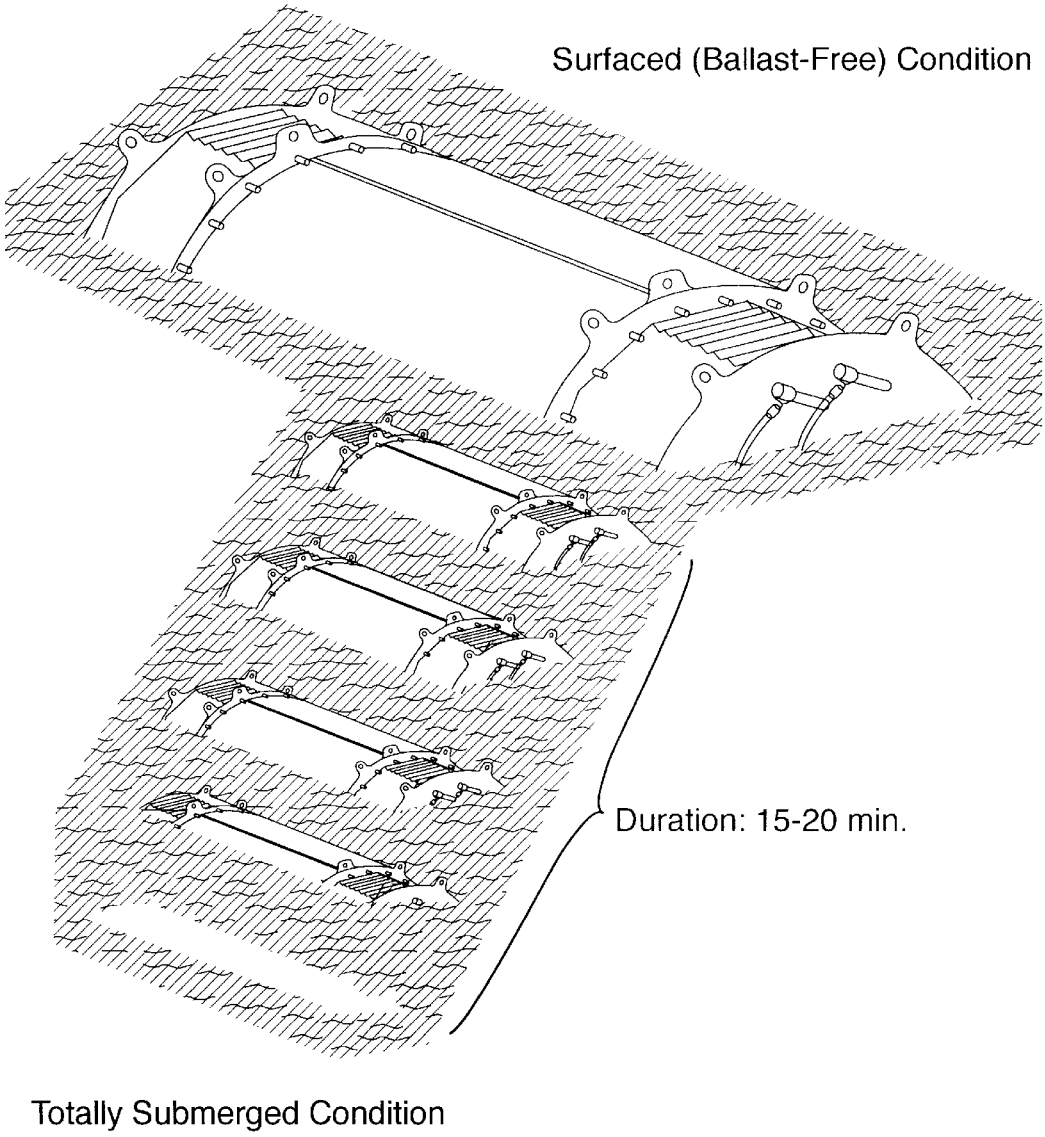

FIG. 10 is a diagrammatic time-lapse view of a typical submergence sequence of the inventive vehicle shown in FIG. 2, which takes place during the flooding of the concertina sections of the inventive vehicle. The duration of such submergence sequence is typically is about fifteen to twenty minutes between a surfaced (ballast free) condition (such as shown at the upper extreme of the figure) and a totally submerged condition (such as shown at the lower extreme of the figure).

Figure 11:
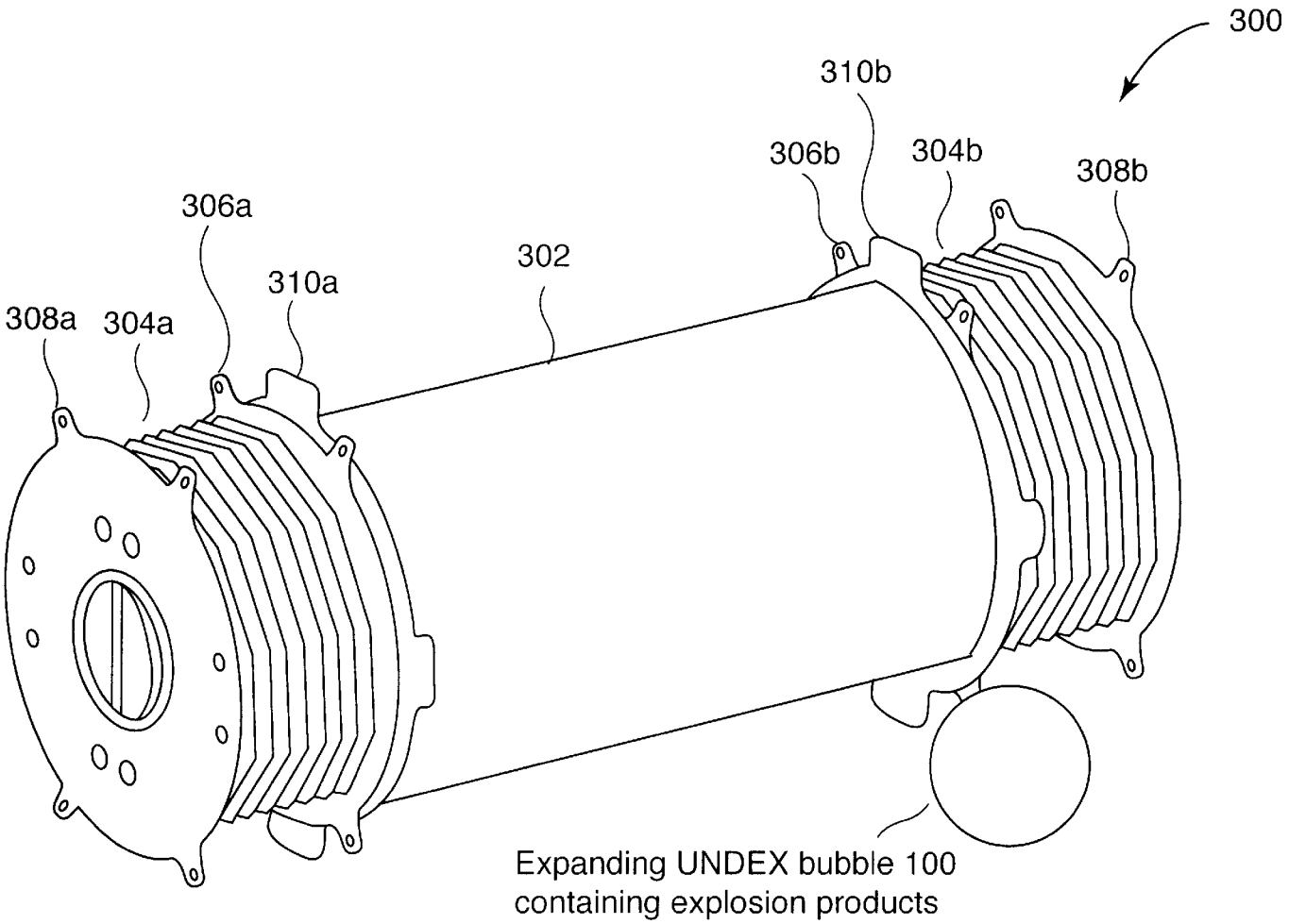
Figure 12A:
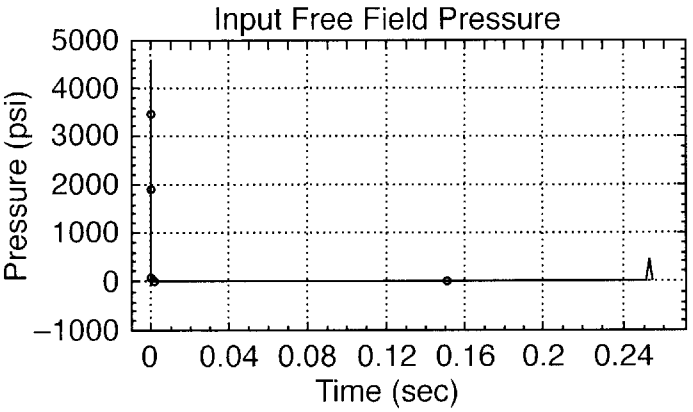
Figure 12B:
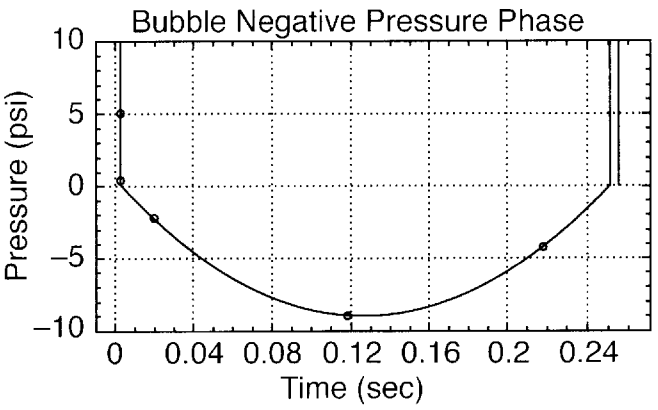
Figure 12C:
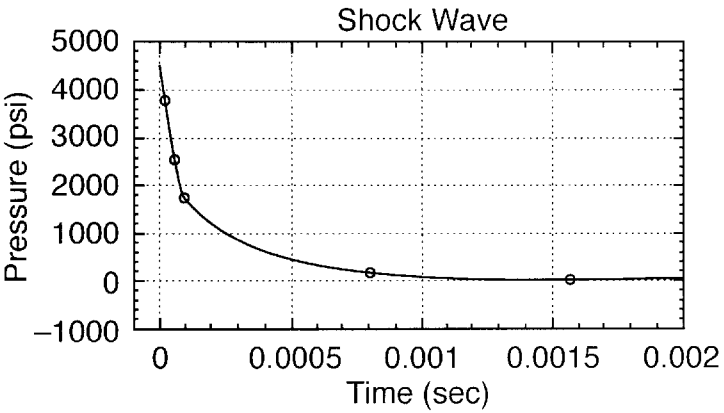
Figure 12D:
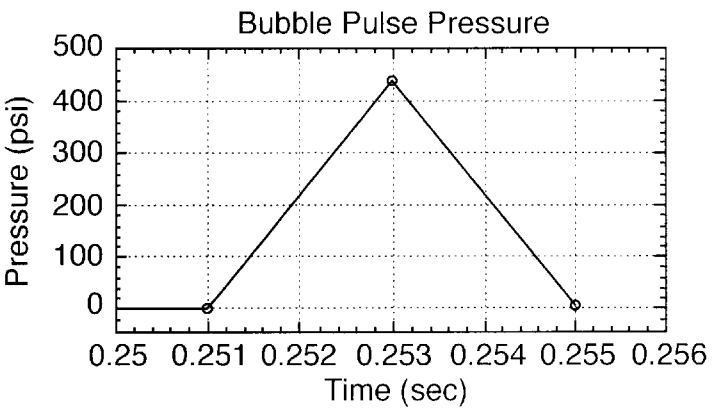
Figure 12E:
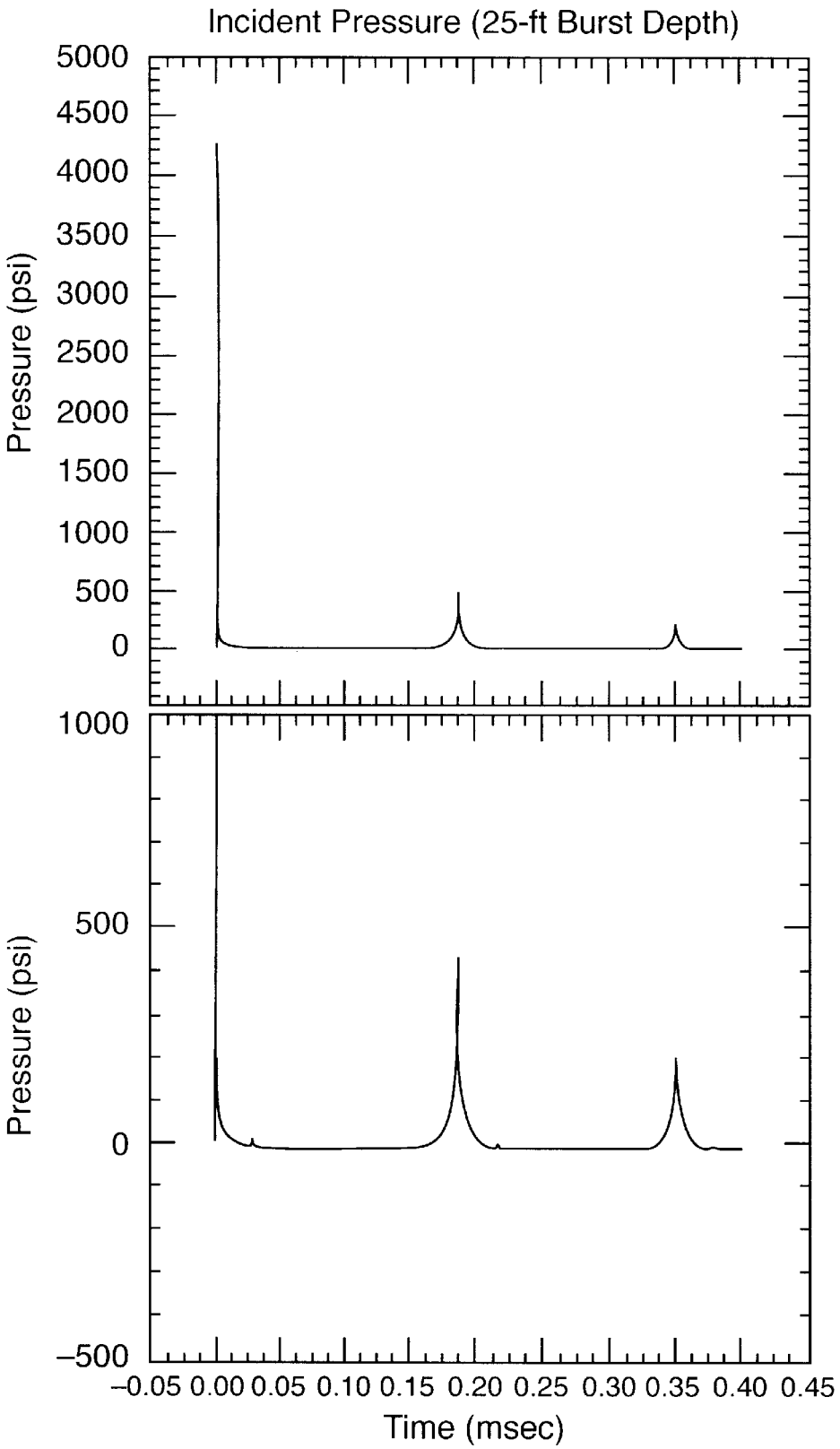

FIG. 11 is a diagrammatic longitudinal perspective view of an illustrative underwater explosion test arrangement for the inventive vehicle shown in FIG. 2, especially depicting, proximate the inventive vehicle, an expanding underwater explosion bubble containing explosion products, the consequence of which is the underwater explosion excitation of the inventive vehicle.

FIG. 12*a*, FIG. 12*b*, FIG. 12*c*, FIG. 12*d* and FIG. 12*e* are graphical representations indicating various aspects of the free field pressure history at a distance, of the inventive vehicle shown in FIG. 2, from a charge equal to the target hull standoff distance (e.g., the free field pressure at the shot node location).

Figure 13:
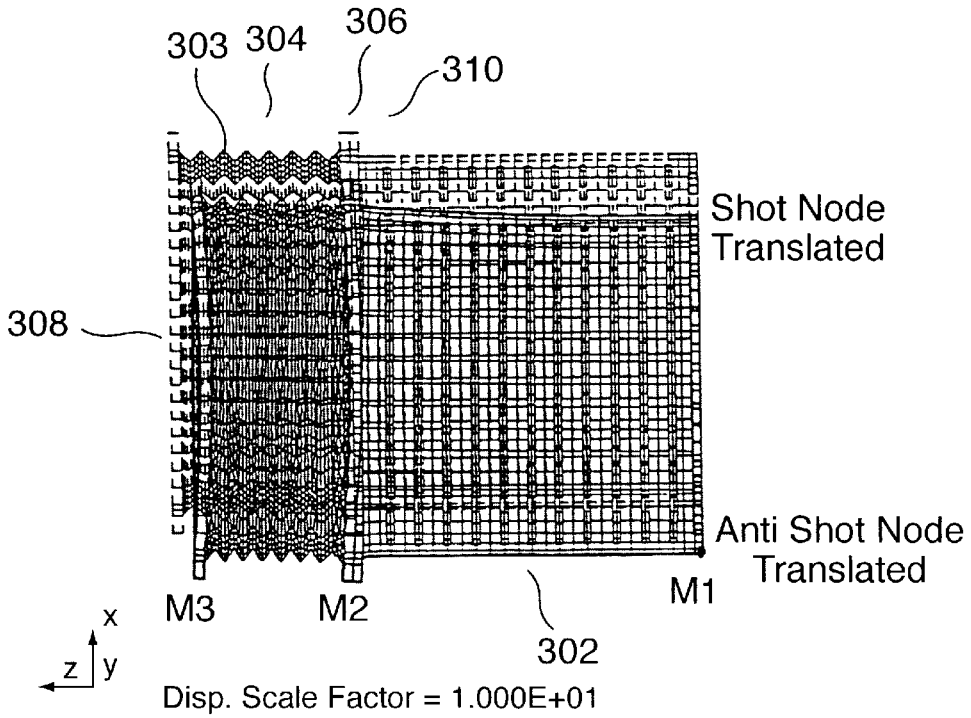

FIG. 13 is a diagrammatic partial (one-quarter) longitudinal elevation view of the inventive vehicle shown in FIG. 2, particularly illustrating beam motion reference planes M1, M2 and M3, wherein plane M1 is the transverse symmetry plane, plane M2 indicates the inboard bulkhead plane, and plane M3 indicates the outboard bulkhead plane. The shot and anti-shot nodes are illustrated via deformed versus undeformed superposition of the inventive vehicle.

Figure 14:
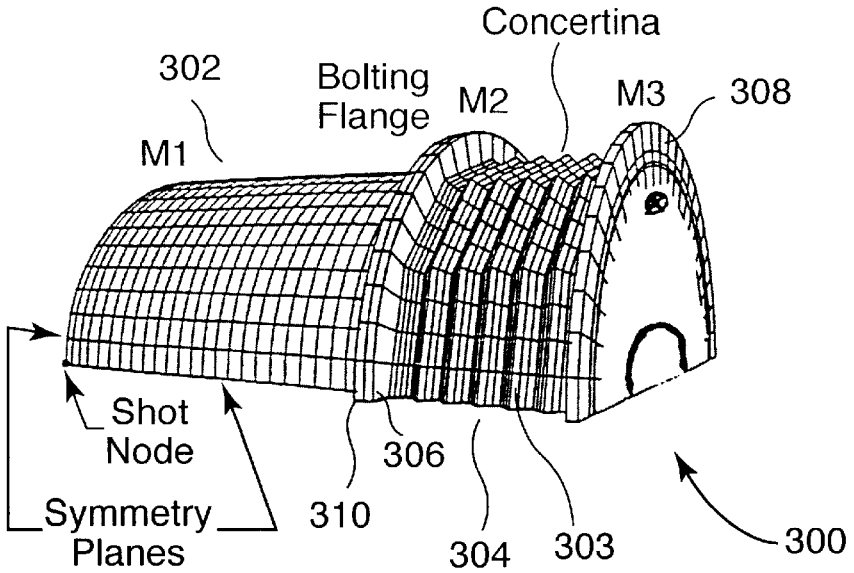

FIG. 14 is a diagrammatic partial (one-quarter) longitudinal top perspective view, similar to the view shown in FIG. 13, of the inventive vehicle shown in FIG. 2, particularly illustrating the beam motion reference planes M1, M2 and M3 shown in FIG. 13. The shot and anti-shot nodes (shot node shown, only) are understood to be diametrically opposed on the transverse symmetry plane M1.

Figure 15:
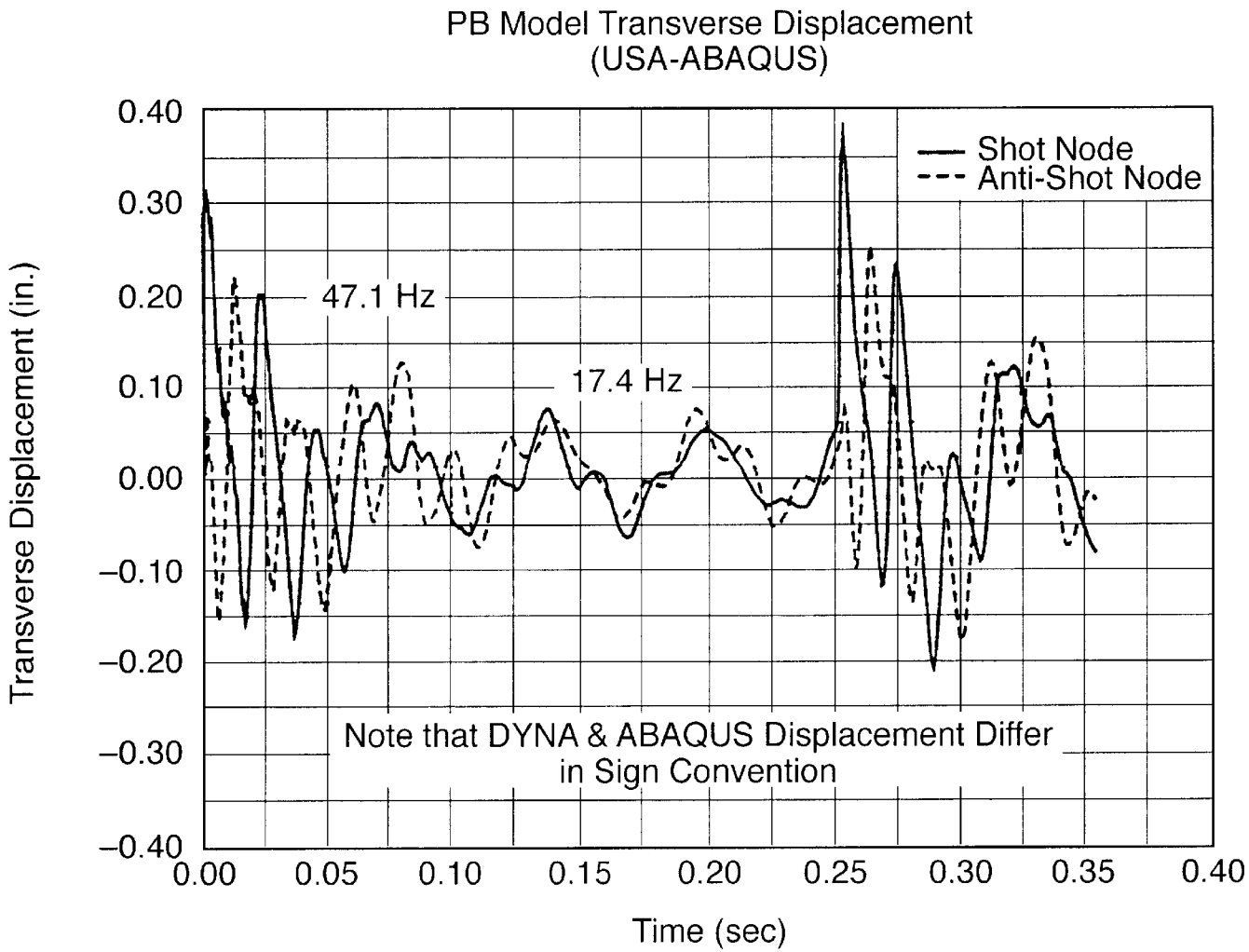

FIG. 15 is a graphical representation of the predicted response histories of a point on the hulk target (the inventive vehicle shown in FIG. 2) nearest the charge (shot node) and its diametric opposite (anti-shot node) on the transverse symmetry plane M1 shown in FIG. 13 and FIG. 14, particularly illustrating shot and anti-shot node response relative to the estimated bodily motion of the inventive vehicle.

Figure 16:
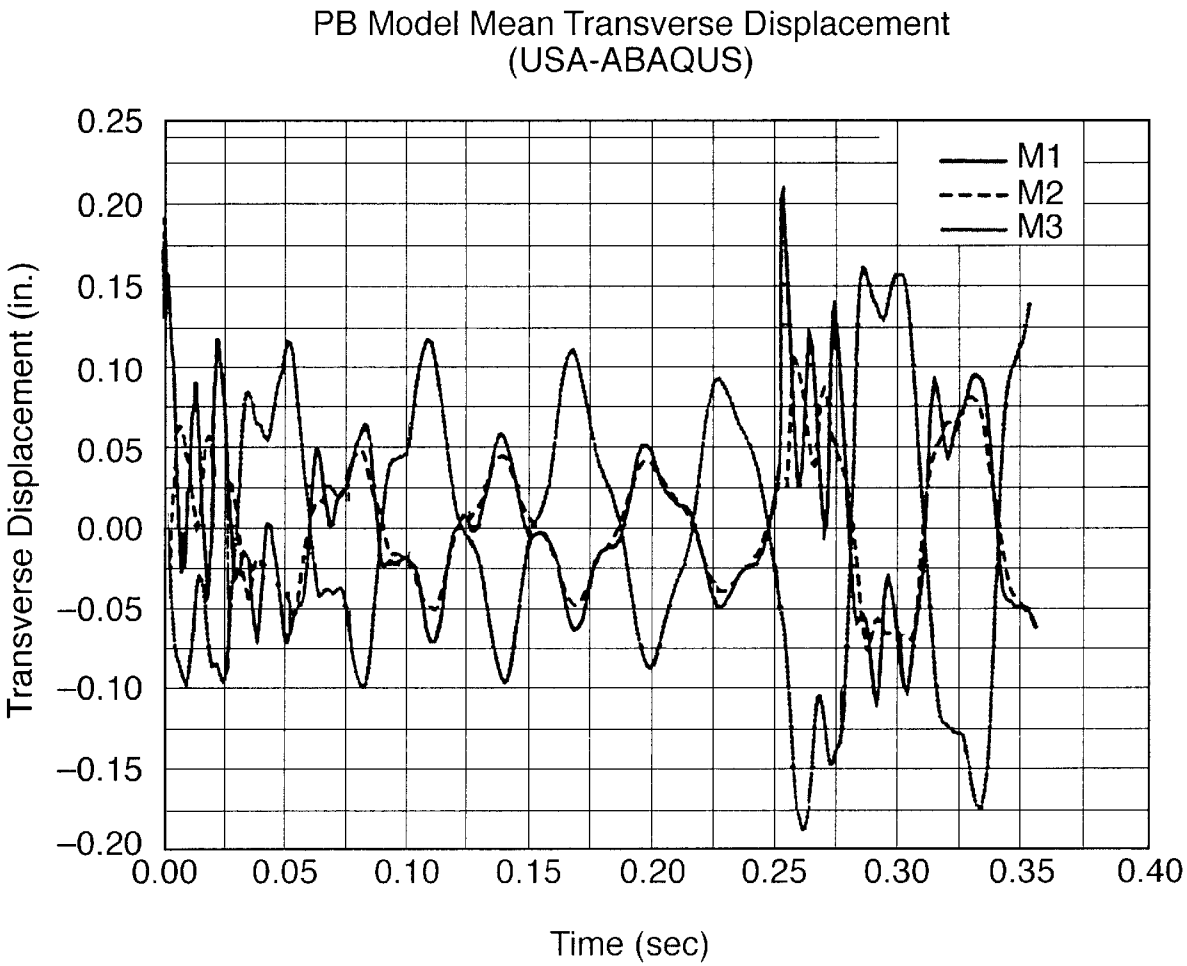
Figure 17:
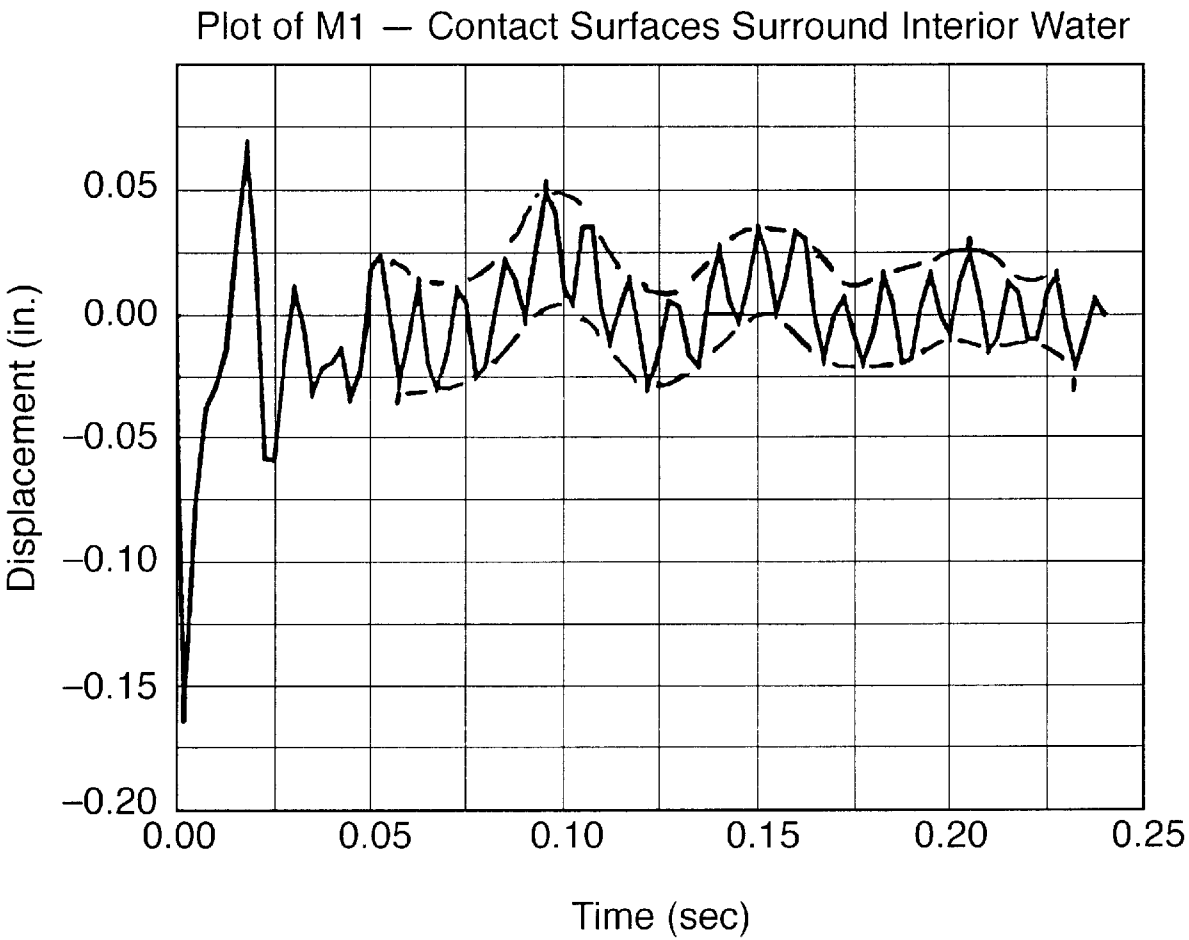

FIG. 16 and FIG. 17 are graphical representations of the predicted cross-sectional response histories along the hull target (the inventive vehicle shown in FIG. 2) at plane M1 (center plane), plane M2 (inboard bulkhead plane) and plane M3 (outboard bulkhead plane), particularly illustrating transverse "beam" motion relative to the estimated bodily motion of the inventive vehicle. FIG. 17 shows two distinct beam modes, viz., (i) 91 Hz, six nodes and (ii) 18 Hz, two nodes. These nodal arrangements are illustrated pictorially in FIG. 19.

Figure 18:
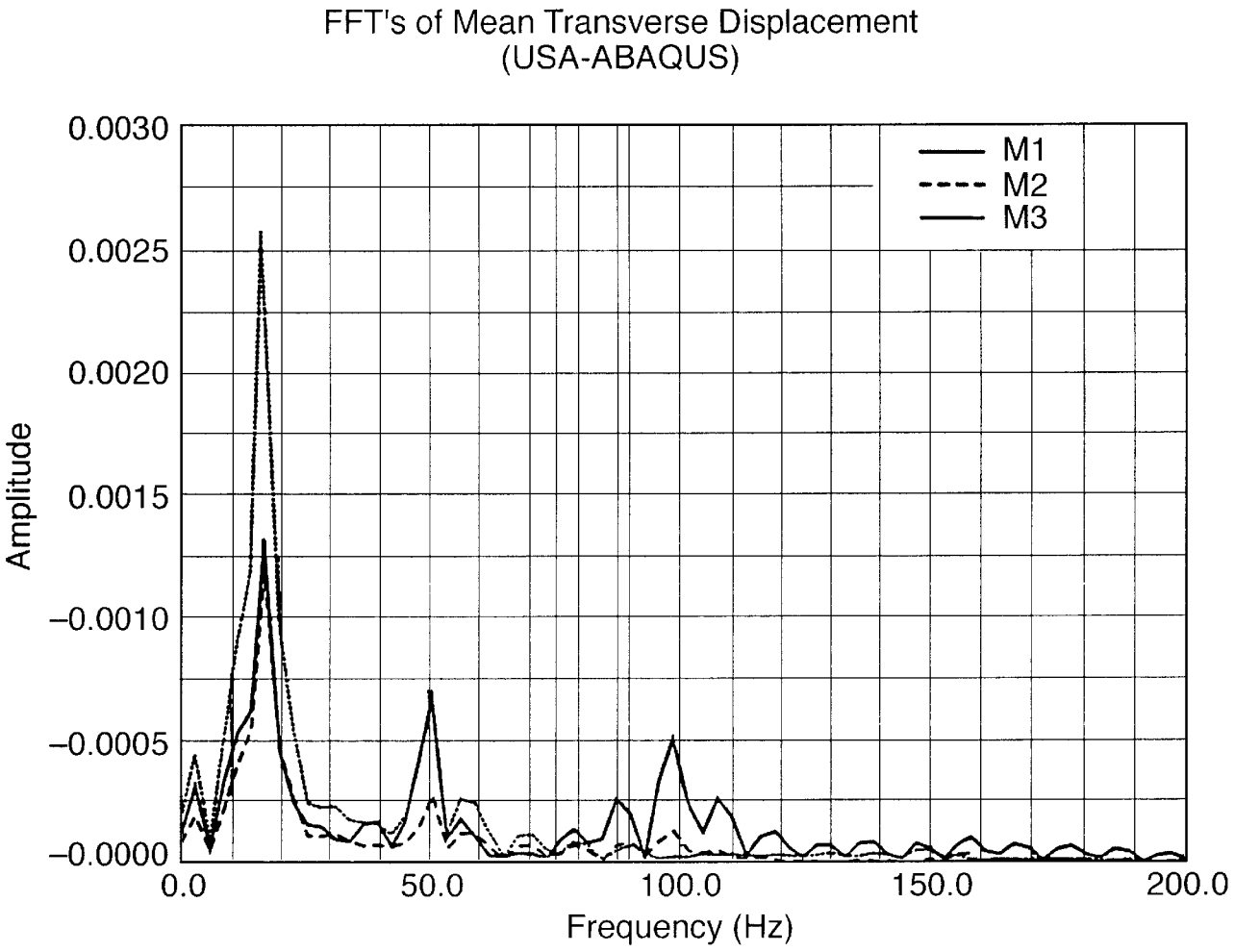

FIG. 18 is a graphical representation of displacement amplitude spectra, also at planar locations M1, M2 and M3.

Figure 19:
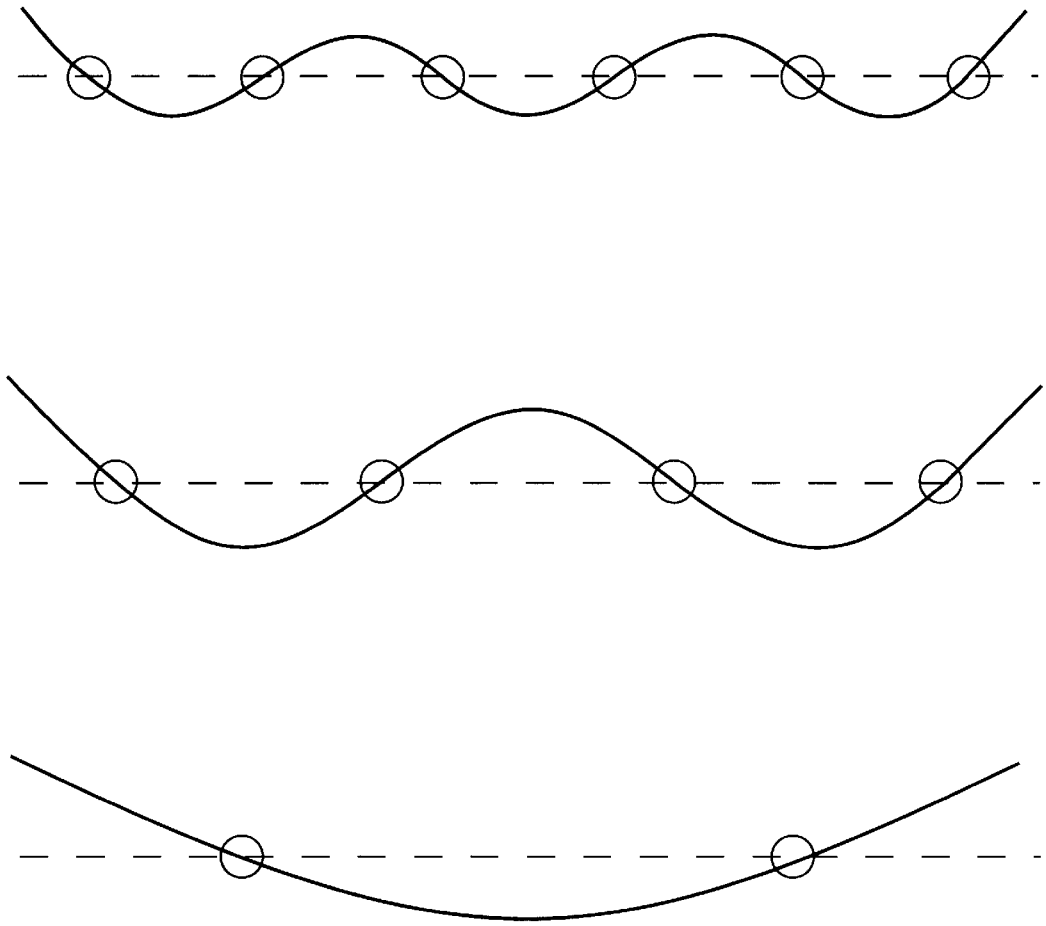

FIG. 19 is a diagrammatic representation of three "beam" bending mode shapes. The lefthand mode shape is a six-node shape which corresponds to the 91 Hz, six node shape graphically represented in FIG. 17. The middle mode shape is a four-node shape. The righthand mode shape is a two-node shape which corresponds to the 18 Hz, two-node shape graphically represented in FIG. 17.

FIG. 20 is a tabular representation of dimensionless frequencies for a free-free prismatic beam.

FIG. 21 is a tabular representation of static and dynamic properties of the inventive vehicle shown in FIG. 2.

DETAILED DESCRIPTION OF THE INVENTION

Figure 1:
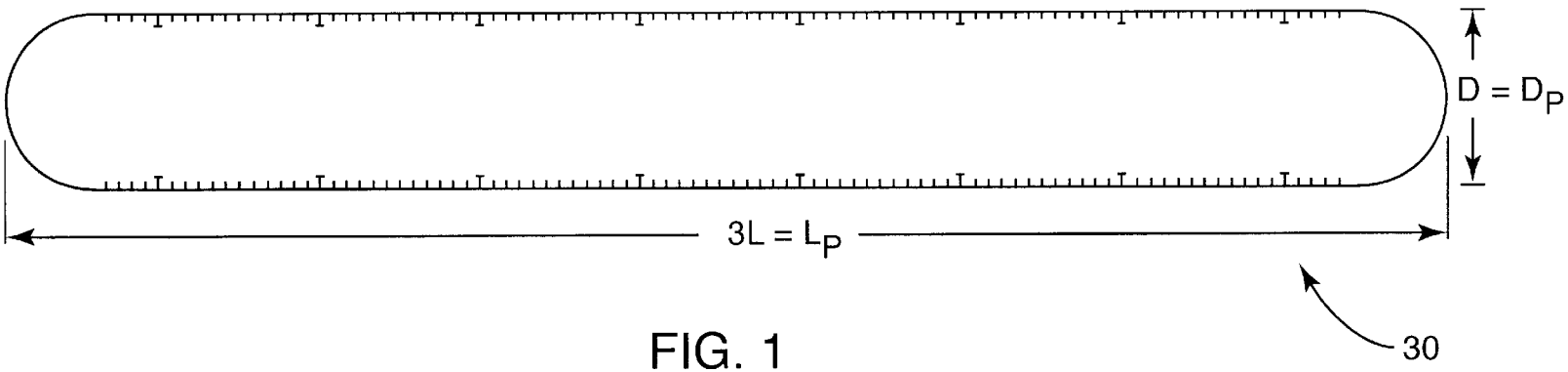
FIG. 1 is a diagrammatic cross-sectional longitudinal elevation view of an embodiment of a "long " prototype vehicle according to conventional practice.

Referring now to FIG. 1 and FIG. 2, the submarine test vehicle in accordance with the present invention is affectionately styled herein the "Poisson Blanc" (PB) model, as distinguished from the so-called "Whitefish" model which has conventionally been used by the U.S. Navy for other (non-UNDEX) testing. The prototypical Whitefish pressure hull 30 is shown in FIG. 1.

The present invention's Poisson Blanc pressure hull 300 is shown in FIG. 2, and represents a same-scale dynamic surrogate of the Whitefish 30 shown in FIG. 1. Poisson Blanc 300 includes three main sections, viz., a cylindrical "rigid" middle hull test section 302 and a pair of cylindroid flexible end concertina sections 304*a* and 304*b*. The middle hull section 302 can be a conventional, at least substantially smooth hollow metallic cylinder, e.g., of the internal circumferential rib-stiffened variety, such as would be manufactured and used according to standard practices. Each concertina section 304 includes a concertina shell portion 305, an inboard bulkhead 306 and an outboard bulkhead 308. According to typical inventive practice, the two concertina sections 304*a* and 304*b* are approximately matching or congruent, such as shown in FIG. 2. Each concertina shell portion 305 has circumferential pleats (e.g., folds or bends) 303. Inboard bulkhead 306 and outboard bulkhead 308 are coupled with concertina shell portion 305 at opposite ends thereof Hence, concertina section 304*a* includes concertina shell portion 305*a* (having circumferential pleats 303*a*), inboard bulkhead 306*a* and outboard bulkhead 308*a*; concertina section 304*b* includes concertina shell portion 305*b* (having circumferential pleats 303*b*), inboard bulkhead 306*b* and outboard bulkhead 308*b*. Poisson Blanc 300 also includes two flange rings (bolt rings) 310*a* and 310*b*.

As shown in FIG. 1 and FIG. 2, the Whitefish 30 and the Poisson Blanc 300 each have a diameter D. That is, the diameter $D_P$ of the Whitefish 30 equals the diameter D of the Poisson Blanc 300. However, the Whitefish 30 is about three times as long as the Poisson Blanc 300. The Whitefish has a length $L_P$=3L, whereas the Poisson Blanc has a length L. Hence, the Whitefish 30 has a length to diameter ratio of $L_P/D_P$=3L/D=8.55, whereas the Poisson Blanc 300 has a length-to-diameter ratio of L/D=2.85. There is an approximate ratio of three-to-one in terms of the size of the Whitefish 30 versus the Poisson Blanc 300, as this ratio would comport with the three-to-one ratio in length L for same or similar diameters D versus $D_P$. Further, as shown in FIG. 1 and FIG. 2, the ratio in weight is roughly commensurate with the ratio in size, namely, about three-to-one.

According to typical inventive embodiments, the Whitefish-versus-PB length ratio constant of three (3) will determine certain relationships between the Whitefish vehicle 30 and the PB vehicle 300 in terms of dimension and mass. The Whitefish-versus-PB diameter scale factor is the ratio of the Whitefish 30 diameter $D_W$ versus the Poisson Blanc 300 diameter D. Hence, the Whitefish-versus-PB length ratio constant of three (3) will be multiplied by the Whitefish-versus-PB diameter scale factor of one (1) for equal (same or similar) diameters D versus $D_P$; thus, if $D=D_P$, the Whitefish 30 will have a length $L_P$ which is three times the length L of the Poisson Blanc. However, the Poisson Blanc length ratio constant three (3) will be multiplied by the Poisson Blanc diameter scale factor of greater than or less than one (1) for unequal (dissimilar) diameters D versus $D_P$; thus, if $D \neq D_P$, the Whitefish 30 will have a length $L_W$ which is three times the Poisson Blanc's length L times the ratio of the Whitefish's diameter $D_W$ to the Poisson Blanc's diameter D. The Whitefish-versus-PB weight ratio, assumed for typical inventive embodiments to be approximately equivalent to the Whitefish-versus-PB diameter length ratio constant three, will be multiplied by the Whitefish-versus-PB diameter scale factor cubed for the case of similar geometries; thus, if the Whitefish-versus-PB weight ratio equals the Whitefish-versus-PB diameter ratio, the Whitefish 30 will have a weight which is three times the Poisson Blanc's length L times the cube of the ratio of the Whitefish's diameter $D_W$ to the Poisson Blanc's diameter D.

In other words, the ratio of the prototypical length to the present invention's surrogate length is approximately three times the ratio of the prototypical diameter to the present invention's surrogate diameter. The ratio of the prototypical weight to the present invention's surrogate weight is approximately three times the cube of the ratio of the prototypical diameter to the present invention's surrogate diameter. Thus, for example, if the ratio of the Whitefish 30 diameter to the Poisson Blanc 300 diameter equals four (4), then the following relationships will obtain: Length would be reduced, in terms of Poisson Blanc 300 length versus Whitefish 30 length, by a factor of one over four times three, or one-twelfth; that is, $1/(4\times3)=1/12^{th}$. Weight would be reduced, in terms of Poisson Blanc 300 weight versus Whitefish 30 weight, by a factor of one over four cubed times three; that is, $1/(4^3\times3)=1/192^{nd}$.

Still with reference to FIG. 2 and also with reference to FIG. 3 through FIG. 10, flange ring 310 (representative of either flange ring 310*a* or flange ring 310*b*) is welded to the medial hull section 302 and, using its thirty-six bolt holes 309 and the corresponding bolts 311, is in turn bolted to inboard bulkhead 306 of the concertina section 304, with watertight seals provided by "O" rings (not shown). Hence, flange ring 310*a* is coupled with medial hull section 302 (at the "a" end of medial hull section 302) and is fastened to inboard bulkhead 306*a*, thereby joining medial hull section 302 and concertina section 304*a*; similarly, flange ring 310*b* is coupled with medial hull section 302 (at the "b" end of medial hull section 302) and is fastened to inboard bulkhead 306*b*, thereby joining medial hull section 302 and concertina section 304*b*.

Figure 4:
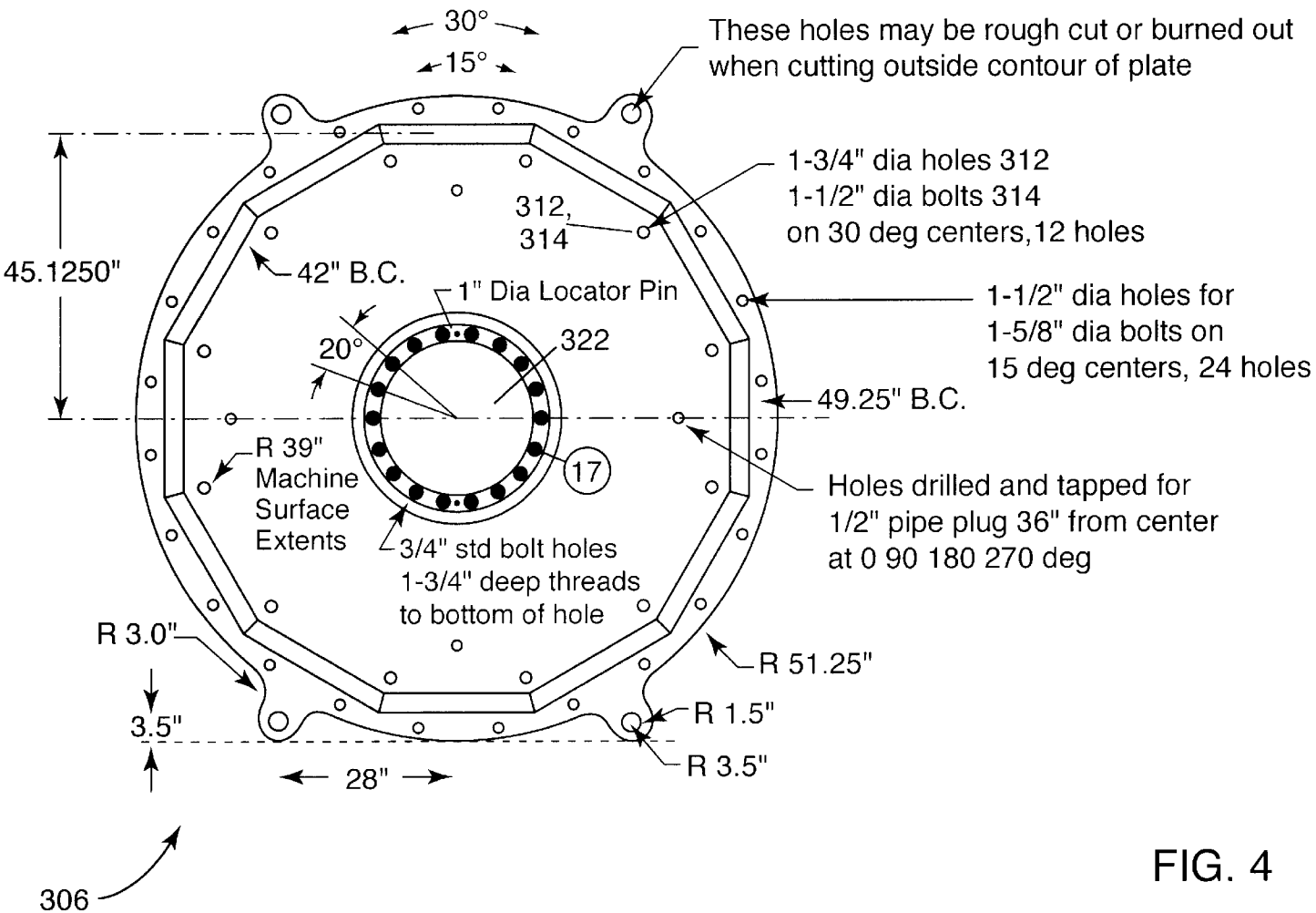
FIG. 4 is a diagrammatic obverse elevation view of one of two identical inboard bulkheads, each secured at the inboard longitudinal end of a concertina and fastened to a bolt ring such as shown in FIG. 3, thereby joining a concertina at a longitudinal end of the medially situated hull section in the inventive vehicle shown in FIG. 2.
Figure 5:
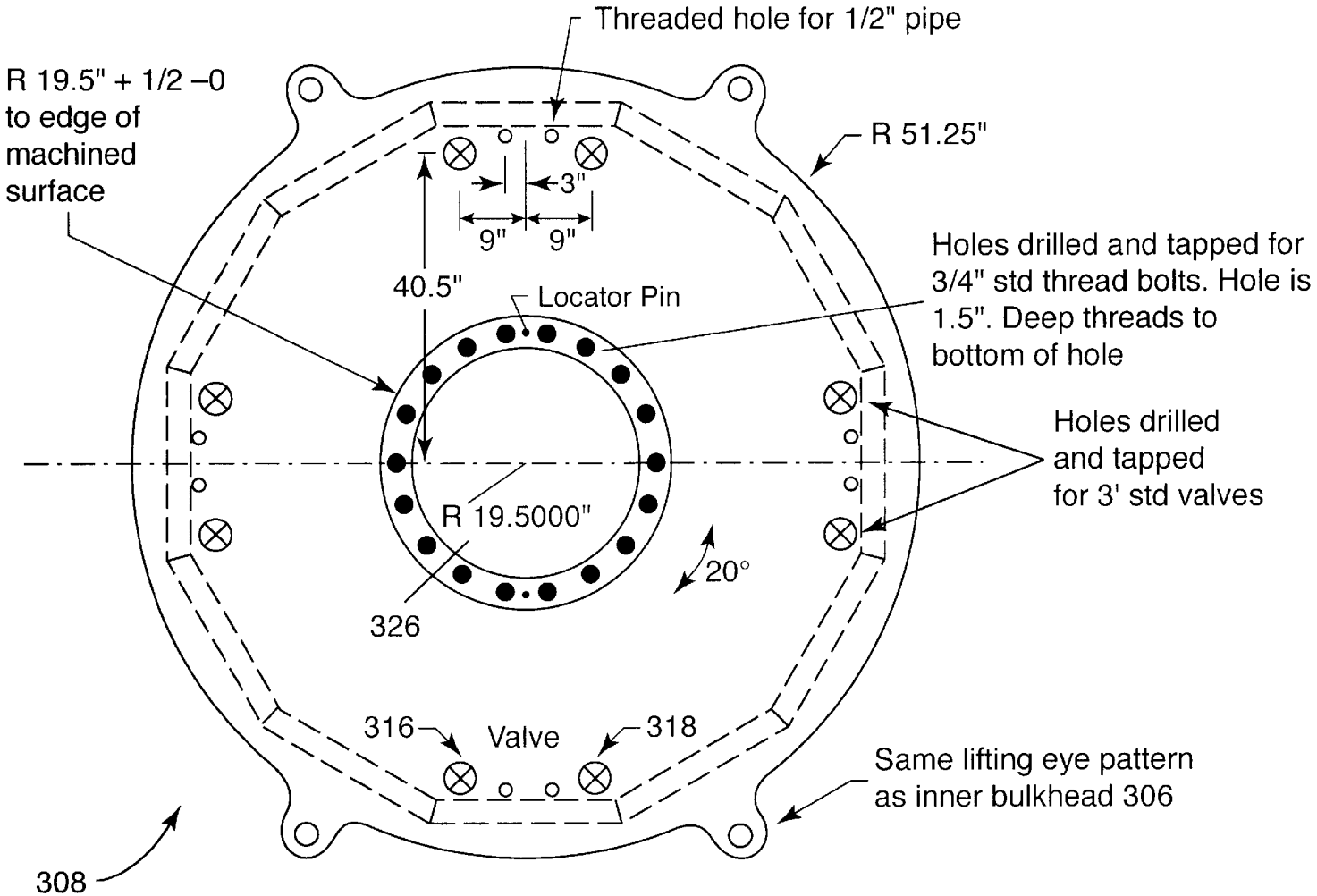
FIG. 5 is a diagrammatic obverse elevation view of one of two identical outboard bulkheads, each secured at the outboard longitudinal end of a concertina in the inventive vehicle shown in FIG. 2.

Details of each inboard concertina bulkhead 306 and each outboard concertina bulkhead 308 are shown in FIG. 4 and FIG. 5, respectively. Using the thirty-six bolt holes 312 provided therein and the corresponding bolts 314, the inboard bulkhead 306 is bolted to the medial hull section 302 via flange ring 310. The outboard bulkhead 308 is equipped with eight holes 316, each drilled and tapped for a 3-inch standard valve 318, situated via the outboard side of outboard bulkhead 308. Each bulkhead includes a "manhole"—e.g., a doorway, hatchway or passageway which may be opened or closed. Inboard bulkhead 306 has a central inboard aperture 320 and an inboard manhole 322 associated therewith. Outboard bulkhead 308 has a central outboard aperture 324 and an outboard manhole 326.

Figure 6:
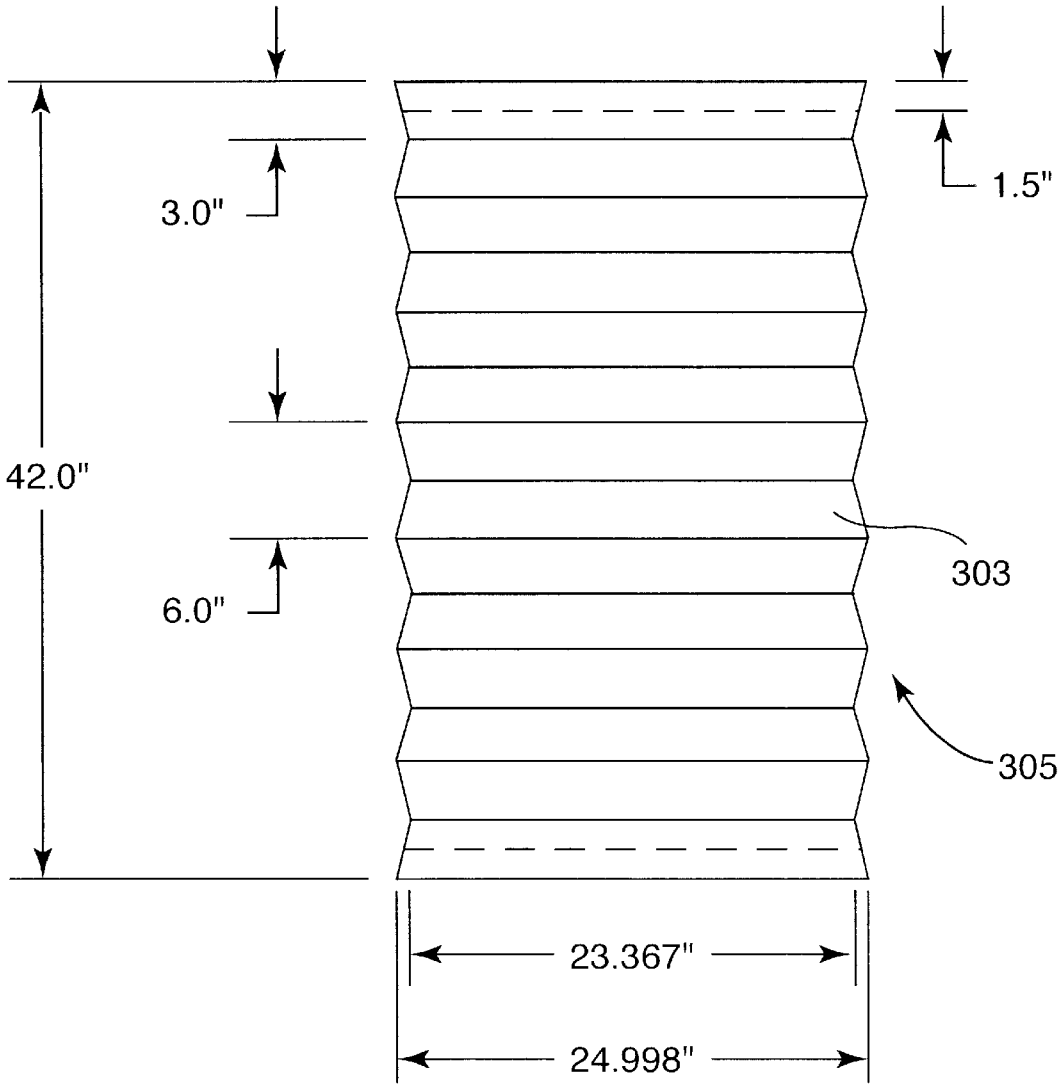
FIG. 6 is a diagrammatic longitudinal elevation view of one of two concertina shell portions (i.e., concertina sections sans inboard and outboard bulkheads) in the inventive vehicle shown in FIG. 2.

As shown in FIG. 5, outboard bulkhead 308 is equipped with remotely controlled valves 318, which receive an air supply from a compressor (not shown in FIG. 5 but understood to be conveniently located elsewhere, e.g., onshore) to "blow" the concertinas 304*a* and 304*b* for post-test surfacing of Poisson Blanc 300. The system provides for submergence (e.g., by gravity or Torricelli inflow) of Poisson Blanc 300 (such as illustrated in FIG. 10, which depicts a series of submergence "snapshots") and an air exhaust for surfacing of Poisson Blanc 300. Details of each concertina shell portion 305 are shown in FIG. 6. Fabrication specifications for the Poisson Blanc 300 which was manufactured for and tested by the U.S. Navy are listed in FIG. 7. For both concertinas 304*a* and 304*b*, the entire concertina was made of mild steel, with the exception of the inner and outer bulkhead hatches, which were made of aluminum; that is, concertina shell 305, inboard bulkhead 306 and outboard bulkhead 308 were each made of a mild steel material, while inboard manhole 322 and outboard manhole 326 were made of an aluminum material. Middle hull section 302 and the two flange rings 310*a* and 310*b* were each made of a high yield (high grade) steel material known as "HY-80."

Figure 8A:
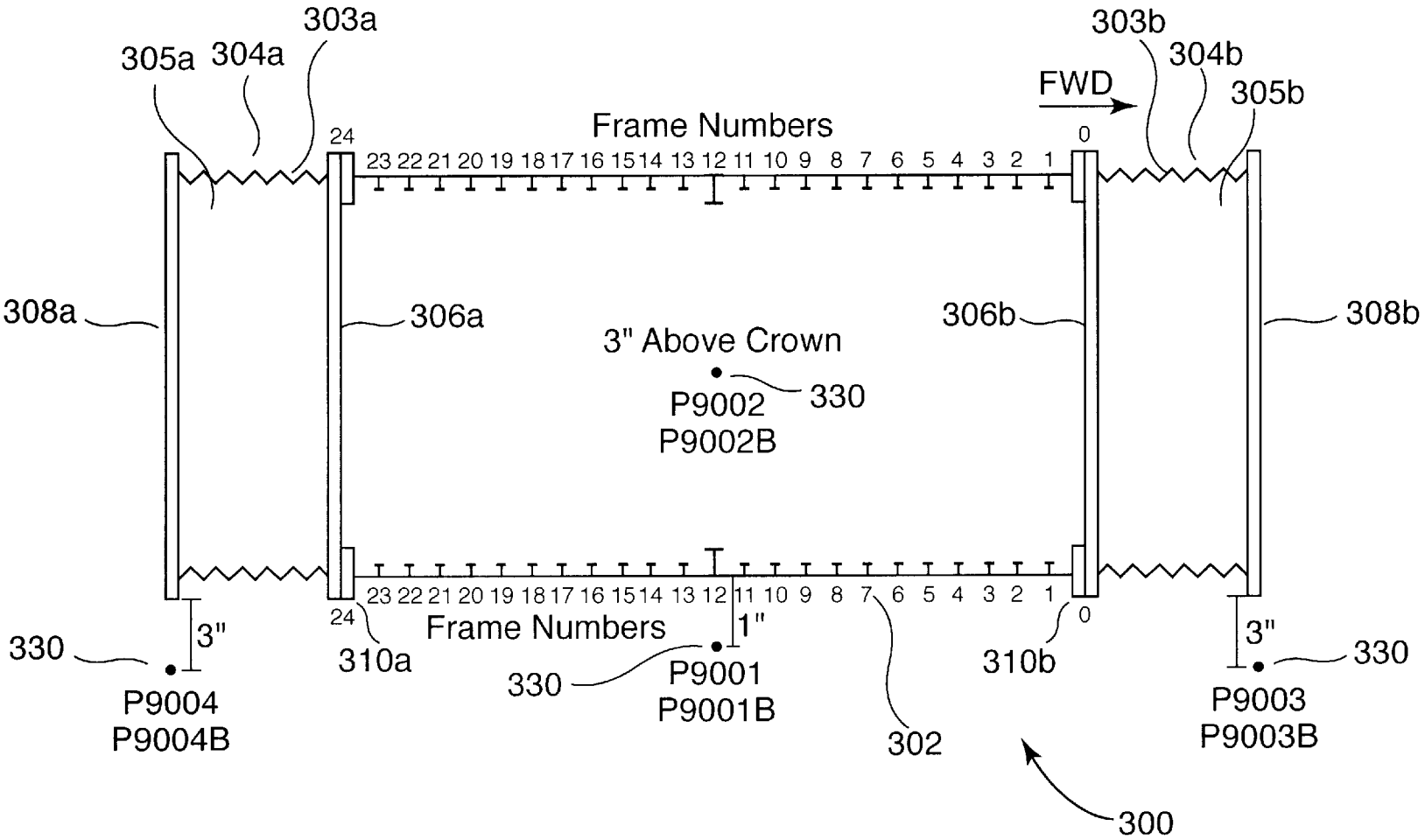
FIG. 8*a*, FIG. 8*b* and FIG. 8*c* are diagrammatic cross-sectional plan views of the inventive vehicle shown in FIG.
Figure 8B:
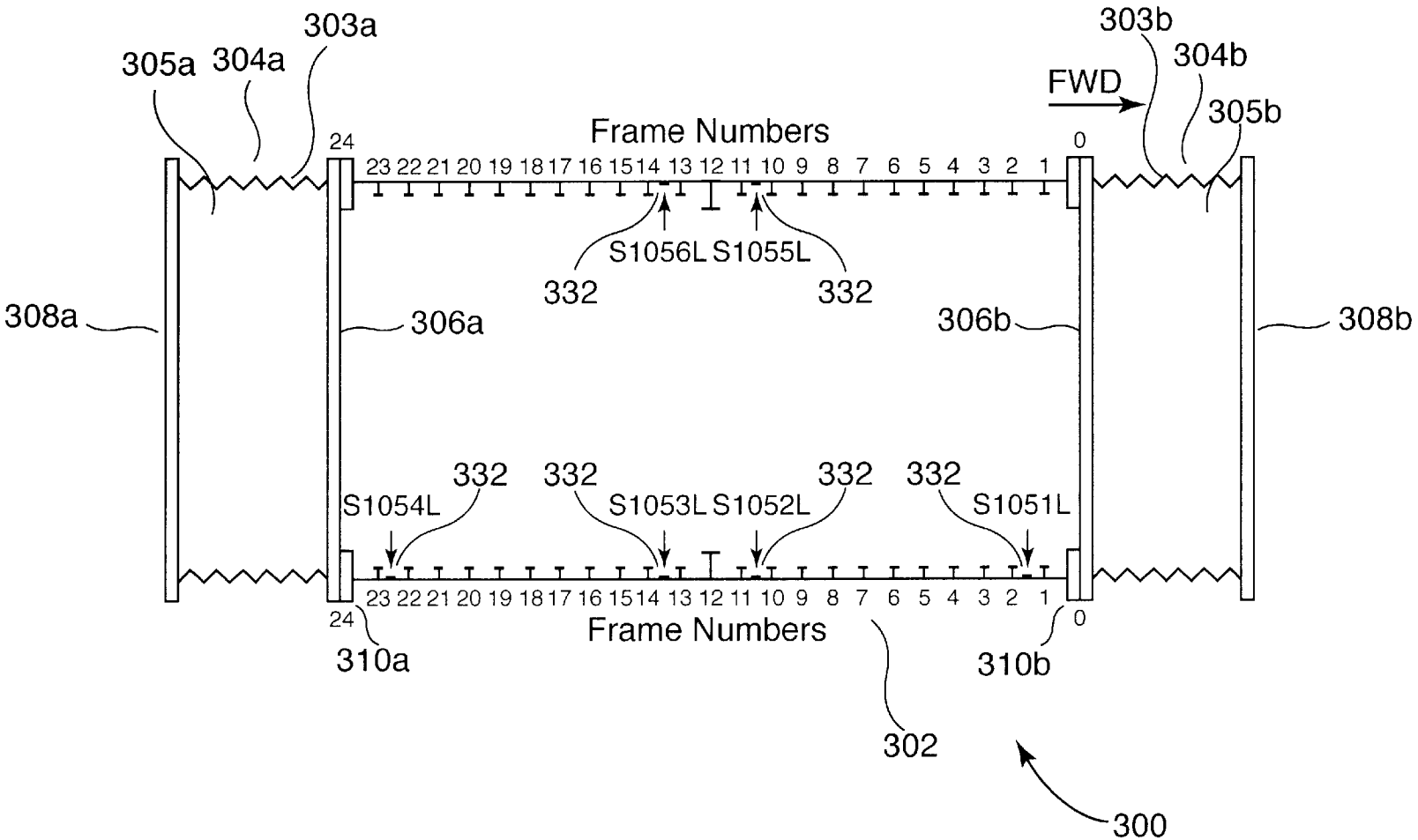
Figure 8C:
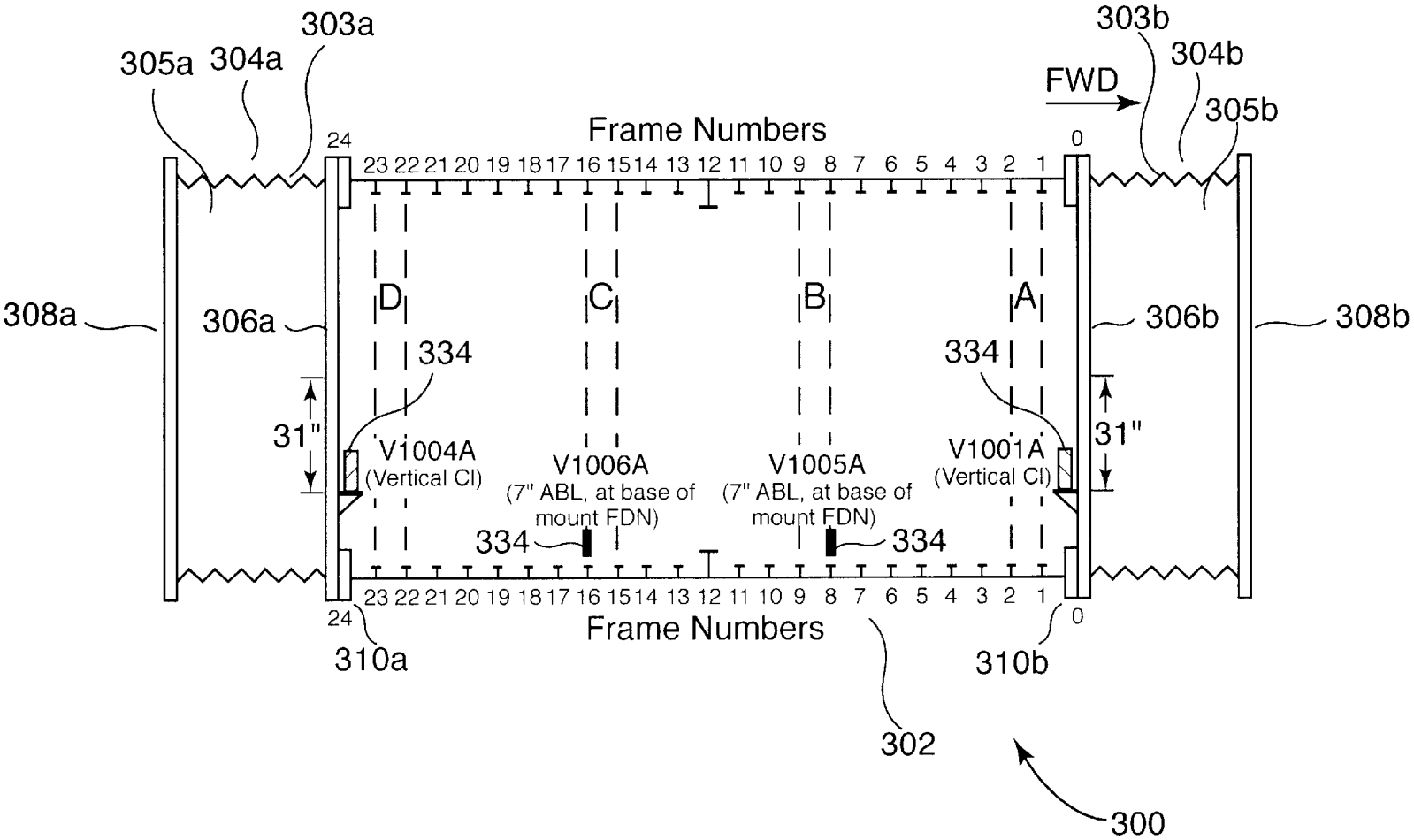

The longitudinal section of FIG. 9 illustrates an arrangement for a space frame (equipment support frame) 328 to support internal equipment inside the middle hull test section 302 of Poisson Blanc 300. Also illustrated is how a means of ingress (entry) and egress (exit) is provided through inboard concertina bulkhead manholes 322*a* and 322*b* as well as through outboard concertina bulkhead manholes 326*a* and 326*b*. Exemplary instrument locations are shown in FIG. 8*a* through FIG. 8*c*. The pressure gauge 330 and strain gauge 332 arrangement schemes in the middle hull test section 302 are shown in FIG. 8*a* and FIG. 8*b*, respectively. Transverse and longitudinal cuts with the velocity meter 334 layout are shown in FIG. 8*c*.

As generally portrayed in the figures, each concertina section 304 has the identical axial-longitudinal length which is approximately twenty-five percent of the axial-longitudinal length of medial hull section 302. That is, the sum of the approximately equal lengths of the two concertina sections 304 is approximately half of the axial-longitudinal length of medial hull section 302. According to many embodiments of the present invention, each concertina section 304 will have approximately the same axial-longitudinal length, and this axial-longitudinal length will be in the range between approximately twenty percent and approximately thirty percent of the axial-longitudinal length of medial hull section 302. In other words, the total axial-longitudinal length of both concertina sections 304 will be in the range between approximately forty percent and approximately sixty percent of the axial-longitudinal length of medial hull section 302. Inventive practice is also possible wherein relative dimensions of the concertina sections 304 and the medial hull section 302 are outside these ranges. Inventive practice is further possible wherein the two concertina sections 304 have unequal axial-longitudinal lengths.

Moreover, as generally portrayed in the figures, medial hull section 302 is approximately cylindrical, and each concertina section 304 is approximately "cylindroid." Medial hull section 304 approximately defines a circular cross-sectional shape. Each concertina section 304 approximately defines a regular polygonal (in particular, twelve-sided) shape which thus generally describes a circular cross-sectional shape. Inventive practice is not limited to cylindrical or cylindroid shapes of the three main sections of the PB vehicle 300. Nor is inventive practice limited to circular or oval or polygonal cross-sectional shapes of any particular kinds. The present invention may be practiced using any of a variety of geometric configurations of the medial hull section 302 and the concertina sections 304 in any of a variety of combinations.

Reference is now made to FIG. 11 through FIG. 20 to clarify operation of the present invention. By way of example, an UNDEX experimental event (without occluding water) is postulated to take place such as that which is portrayed in FIG. 11. The PB target vehicle 300 is struck first by a shock wave emanating from the detonation just initiated at the center of the spherical detonation products bubble 100. A free field pressure history at standoff is shown in FIG. 12*a* through FIG. 12*e*; shown in these figures is a typical free field incident pressure history in the vicinity of PB vehicle 300. Shell UNDEX response of Poisson Blanc vehicle 300 at shot/anti-shot nodes is illustrated in FIG. 13 and FIG. 15; as demonstrated in these figures, the ensuing early shock response of Poisson Blanc vehicle 300 is of relatively high frequency, which decays rapidly. Flexural beamlike hull UNDEX response of PB vehicle 300 is shown in FIG. 14 and FIG. 16. Highest frequency detectable in FIG. 13 and FIG. 15 is the circumferentially elliptical fist lobar, at about 47 Hz. Then, the bubble 100 (having passed its maximum and subsequently contracted to a minimum) causes a "bubble pulse" to be emitted due to the arrest of water inflow by highly compressed detonation products. Thus, as illustrated in FIG. 14 and FIG. 16 through FIG. 20, the motion of lower frequency "beam" modes ranges from ~4 Hz bodily translational due to bubble induced flow, to ~17 Hz, lowest bending, and further, up to 50 and 100 Hz, geometrically more complex vibrational modes. FIG. 19 and FIG. 20 are taken from L. S. Jacobsen and R. S. Ayre, *Engineering Vibrations*, McGraw-Hill, New York, 1958, incorporated herein by reference. A summary of static and dynamic properties of the present invention's Poisson Blanc vehicle 300 is given in FIG. 21. The inventive testing demonstrated that the inventive PB's response to underwater explosion loading simulates or mimics that of the Whitefish. The inventive PB thus represents a dynamic surrogate of the longer, prototypical Whitefish.

Also incorporated herein by reference are the following two U.S. Navy technical reports: Michael M. Swisdak, Jr., "Explosion Effects and Properties: Part I—Explosion Effects in Air," NSWC/WOL TR 75-116, White Oak Laboratory, Naval Surface Weapons Center, White Oak, Md. (October 1975); Michael M. Swisdak, Jr., "Explosion Effects and Properties: Part II—Explosion Effects in Water," NSWC/WOL TR 76-116, White Oak Laboratory, Naval Surface Weapons Center, White Oak, Md. (Feb. 22, 1978).

Especially with reference to FIG. 11, the present invention's Poisson Blanc target vehicle 300 is set in motion by an UNDEX occurrence within its event horizon. This motion encompasses the entire PB vehicle 300 structure within a very short time period that is at least largely governed by the PB vehicle 300 model size and the wave propagation speeds which are characteristic of the PB vehicle 300 construction material. Standing waves, which additionally depend on PB vehicle 300 geometry, are set up quickly throughout the entire PB vehicle 300 structure. The subsequent internal equipment response idiosyncrasies are dictated by the space frame 328 mounting structure and by types of mitigating devices present as well as their extent and arrangement. Therefore, generally speaking, UNDEX response of the present invention's test vehicle 300 depends both on intrinsic characteristics and on excitation.

Survival under maximum allowable UNDEX load with the charge placed optimally for "whipping" (beamlike bending) was a prerequisite for design of the Poisson Blanc 300 test vehicle. A shot geometry, or charge placement scheme relative to the PB vehicle 300 target, for optimal whipping, was used to make response predictions such as described herein. It was hoped that subsequent tests would make use of the identical test conditions so that the validity of the pre-test predictions could be checked to the maximum extent possible and so that maximum advantage could be taken of inventive vehicle 300 design. Such, for reasons unknown to the inventor and his colleagues, turned out not to be the case. Experimental charge and, consequently, standoff, were made considerably greater than those incorporated into original design analysis calculations, thus vitiating optimal bending response, a central beneficial characteristic of the present invention's vehicle 300. Accordingly, only the predicted response of the PB vehicle 300 is discussed herein.

Nevertheless, experimental results demonstrated the utility of the present invention's vehicle 300. Since the primary motivation for the present invention was to recover a few low frequency "bending/accordion" modes resembling those found in the Whitefish test vehicle 30 prototype model, the Poisson Blanc test vehicle 300 surrogate model has been shown to have satisfied performance criteria postulated at the outset. The inventive testing was successful in other respects, such as the following: smooth submergence ("diving") characteristics of the PB vehicle 300; undamaged and dry survival of the PB vehicle 300 when subjected to maximum design UNDEX load; the provision by the PB vehicle 300 of a snug "haven" cradling the instrumentation necessary for conducting a successful "proof of concept" experiment.

The present invention demonstrated the ability to house various forms of experimental apparatus and to provide the necessary structure for such purposes, including a loaded space frame carried by semi-active mounts of a very complex, though robust nature, as well as masses simulating equipment. The present invention further demonstrated the ability to house computer equipment, as the computers controlling these semi-active mounts "rode" on the same space frame, undamaged, throughout the inventive testing. The present invention's surrogate test model can be applied to (i.e., based on) any size prototype test model, up to and perhaps including a prototype test model intended for a full-scale submersible test. In inventive principle, the present invention can be practiced even for surface ship prototype test models in order to realize savings, since the inventive surrogate test model can retain model response fidelity with respect to the prototype test model.

Other embodiments of this invention will be apparent to those skilled in the art from a consideration of this specification or practice of the invention disclosed herein. Various omissions, modifications and changes to the principles described may be made by one skilled in the art without departing from the true scope and spirit of the invention which is indicated by the following claims.

What is claimed is:

1. A vehicle comprising three hollow, axially aligned, axially symmetrical sections, said three sections being a hull section and two bellows sections, said hull section having two hull section ends, each said bellows section generally describing a perimetrically pleated shape and being attached at a said hull section end.

2. A vehicle as recited in claim 1, wherein said vehicle is adaptable to use in association with explosion means for testing response to underwater explosion, and wherein said bellows sections attribute said vehicle with axial and bending flexibility responsive to said underwater explosion.

3. A vehicle as recited in claim 1, wherein each said bellows section includes valvular fluid inlet/outlet means.

4. A vehicle as recited in claim 1, wherein each said bellows section is adapatable to being filled with said fluid for providing ballast for said vehicle.

5. A vehicle as recited in claim 1, wherein each said bellows section cross-sectionally at least approximately defines a regular polygon.

6. A vehicle as recited in claim 1, wherein said regular polygon is a twelve-sided polygon.

7. A vehicle as recited in claim 1, wherein each said bellows section has approximately the same bellows section axial length.

8. A vehicle as recited in claim 7, wherein said hull section has a hull section axial length, and wherein each said bellows section axial length is approximately twenty-five percent of said hull section axial length.

9. A vehicle as recited in claim 7, wherein said hull section has a hull section axial length, and wherein each said bellows section axial length is in the range between approximately twenty percent of said middle section axial length and approximately thirty percent of said hull section axial length.

10. A vehicle as recited in claim 1, wherein:

each said bellows has an inboard bellows end and an outboard bellows end;

said vehicle further comprises two inboard end-plates and two outboard end-plates; and each said bellows is coupled with two said end-plates wherein a said inboard end-plate is situated at said inboard bellows end and a said outboard end-plate is situated at said outboard bellows end.

11. A vehicle as recited in claim 10, wherein:

said vehicle further comprises two flange members;

said hull section is coupled with said flange members wherein a first said flange member is situated at a first said hull section end and a second said flange member is situated at a second said hull section end.

12. A vehicle as recited in claim 11, wherein each said bellows section is attached at a said hull section end so that a said inboard endplate is fastened to a said flange member.

13. A submersible test device, said submersible test device being a first submersible test device characterized by a first diameter, a first length and a first longitudinal axis, said first submersible test device comprising three coaxial portions, said three coaxial portions being a rigid medial portion and two flexible extreme portions, said first submersible test device being capable of duplicating the flexural response to an underwater explosion of a second submersible test device characterized by a second diameter, a second length and a second longitudinal axis, wherein the ratio of said second length to said first length is approximately three times the ratio of said second diameter to said first diameter.

14. The submersible test device according to claim 13, wherein said medial rigid portion has a void adaptable to accommodating instrumentation means suitable for ascertaining said response.

15. The submersible test device according to claim 13, wherein each said flexible extreme portion has plural peripheral folds which attribute axial and lateral flexibility to said flexible extreme portion.

16. The submersible test device as defined in claim 13, wherein each said flexible extreme portion includes a corresponding ballasting means for causing said first submersible test device to submerge and surface, and wherein each said ballasting means includes a corresponding chamber means for fluid containment and a corresponding valvular means for adjusting said fluid containment.

17. The submersible test device as defined in claim 13, wherein:

said first submersible test device is characterized by a first weight;

said second submersible test device is characterized by a second weight; and the ratio of said second weight to said first weight is approximately three times the cube of the ratio of said second diameter to said first diameter.

18. A method for measuring the response of a full-scale marine vessel to an underwater explosion, said method comprising:

designing a prototypical reduced-scale marine vessel which corresponds to said full-scale marine vessel, said prototypical reduced-scale marine vessel having a prototypical diameter, a prototypical length and a prototypical longitudinal axis;

providing a surrogate reduced-scale marine vessel which is based on said prototypical reduced-scale marine vessel, said surrogate reduced-scale marine vessel having a surrogate diameter, a surrogate length and a surrogate longitudinal axis, said surrogate reduced-scale marine vessel comprising a rigid medial surrogate portion and two flexible extreme surrogate portions, said surrogate reduced-scale marine vessel being capable of duplicating the flexural response to an underwater explosion of said prototypical reduced-scale marine vessel, wherein the ratio of said prototypical length to said surrogate length is approximately three times the ratio of said prototypical diameter to said surrogate diameter.

19. A method for measuring as defined in claim 18, further comprising:

rendering said rigid medial surrogate portion so as to include sensor means;

effectuating said underwater explosion in the vicinity of said reduced-scale marine vessel; and using said sensor means for said measuring.

20. A method for measuring as defined in claim 19, further comprising:

rendering each said flexible extreme surrogate portion so as to include a cavity for containing fluid and a valve for regulating said containing of said fluid; and with respect to each said flexible extreme surrogate portion, using said valve for at least partially filling said cavity with said fluid so that said reduced-scale marine vessel is completely underwater.

* * * * *